US010203616B2

(12) United States Patent
Yoshizawa et al.

(10) Patent No.: US 10,203,616 B2
(45) Date of Patent: Feb. 12, 2019

(54) ELECTROPHOTOGRAPHIC PHOTORECEPTOR, ELECTROPHOTOGRAPHIC PHOTORECEPTOR CARTRIDGE, AND IMAGE FORMING APPARATUS

(71) Applicant: MITSUBISHI CHEMICAL CORPORATION, Tokyo (JP)

(72) Inventors: Atsushi Yoshizawa, Kanagawa (JP); Wataru Miyashita, Kanagawa (JP); Mitsuo Wada, Kanagawa (JP); Akiteru Fujii, Kanagawa (JP); Takayuki Shouda, Kanagawa (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 42 days.

(21) Appl. No.: 15/622,843

(22) Filed: Jun. 14, 2017

(65) Prior Publication Data

US 2017/0285498 A1 Oct. 5, 2017

Related U.S. Application Data

(63) Continuation of application No. PCT/JP2015/084704, filed on Dec. 10, 2015.

(30) Foreign Application Priority Data

Dec. 17, 2014 (JP) ..... 2014-255338
Sep. 29, 2015 (JP) ..... 2015-191607

(51) Int. Cl.
*G03G 5/00* (2006.01)
*G03G 5/06* (2006.01)
(Continued)

(52) U.S. Cl.
CPC ..... *G03G 5/0614* (2013.01); *G03G 5/047* (2013.01); *G03G 5/056* (2013.01); *G03G 5/0542* (2013.01); *G03G 5/0564* (2013.01); *G03G 5/0603* (2013.01); *G03G 5/0605* (2013.01); *G03G 5/0607* (2013.01); *G03G 5/0609* (2013.01); *G03G 5/0616* (2013.01); *G03G 5/0629* (2013.01); *G03G 5/0637* (2013.01);
(Continued)

(58) Field of Classification Search
CPC ..... G03G 5/0614
USPC ..... 430/72
See application file for complete search history.

(56) References Cited

U.S. PATENT DOCUMENTS 5,780,194 A 7/1998 Katsukawa et al.
2008/0227007 A1 9/2008 Tamoto et al.
2014/0106269 A1 4/2014 Tanaka et al.

FOREIGN PATENT DOCUMENTS

JP 61-270765 A 12/1986
JP 05-307270 A 11/1993
(Continued)

OTHER PUBLICATIONS

International Search Report dated Mar. 8, 2016 for the corresponding PCT Application No. PCT/JP2015/084704.

*Primary Examiner* — Mark A Chapman
(74) *Attorney, Agent, or Firm* — Leason Ellis LLP

(57) ABSTRACT

The present invention relates to an electrophotographic photoreceptor comprising: a conductive support; and a photosensitive layer on the conductive support, wherein the photosensitive layer contains a charge transport substance, a
(Continued)

binder resin, and a compound which has a molecular weight of equal to or less than 350, and is represented by General Formula (1).

7 Claims, 2 Drawing Sheets

(51) Int. Cl.

| | |
|---|---|
| ***G03G 5/047*** | (2006.01) |
| ***G03G 5/05*** | (2006.01) |
| ***G03G 5/10*** | (2006.01) |
| ***G03G 5/14*** | (2006.01) |
| ***G03G 15/00*** | (2006.01) |

(52) U.S. Cl.
CPC ..... *G03G 5/0651* (2013.01); *G03G 5/0657* (2013.01); *G03G 5/0668* (2013.01); *G03G 5/0672* (2013.01); *G03G 5/0696* (2013.01); *G03G 5/102* (2013.01); *G03G 5/142* (2013.01); *G03G 15/75* (2013.01); *G03G 2215/00957* (2013.01)

(56) References Cited

FOREIGN PATENT DOCUMENTS

| | | | |
|---|---|---|---|
| JP | 08-286398 | A | 11/1996 |
| JP | 2008-262174 | A | 10/2008 |
| JP | 2010-122632 | A | 6/2010 |
| JP | 2010-237555 | A | 10/2010 |
| JP | 2011-170041 | A | 9/2011 |
| JP | 2012-048123 | A | 3/2012 |
| JP | 2013-041102 | A | 2/2013 |
| JP | 2014-095888 | A | 5/2014 |

ELECTROPHOTOGRAPHIC PHOTORECEPTOR, ELECTROPHOTOGRAPHIC PHOTORECEPTOR CARTRIDGE, AND IMAGE FORMING APPARATUS

CROSS-REFERENCE TO RELATED PATENT APPLICATIONS

This application is a continuation application under 35 U.S.C. § 111(a) of International Patent Application No. PCT/JP2015/084704 filed on Dec. 10, 2015, and claims the benefit of Japanese Patent Application No. 2014-255338 filed Dec. 17, 2014 and Japanese Patent Application No. 2015-191607 filed Sep. 29, 2015, all of which are hereby incorporated by reference herein in their respective entireties.

TECHNICAL FIELD

Electrophotography has been widely used as a copier, a printer, or a printing machine from the viewpoint of instantaneously obtaining high-quality images. With respect to an electrophotographic photoreceptor (hereinafter, properly referred to as a "photoreceptor"), which is the core of electrophotography, a photoreceptor which employs an organic photoconductive material having advantages such as non-pollution, ease of film formation, and ease of production has been mainly used.

An image forming apparatus based on the electrophotography has been required to attain higher image quality, higher speed, and higher durability year after year. Although processes conducted on the periphery of the photoreceptor, such as charging, exposure, development, and transfer, also are being individually improved in order to satisfy those requirements, the improvements are not always sufficient or are not adopted for reasons of cost, in many cases. In such cases, improvements in photoreceptors are necessary.

For example, in a case of using toner which has a shape close to sphere, such as a chemical toner, cleaning is difficult and thus, a technique of increasing the pressure with respect to the photoreceptor of the cleaning blade is frequently used. In this case, not only the degree of wear of the photoreceptor is increased, but also problems are likely to occur, such as adhesion of a component of the toner to the photoreceptor surface (filming), the occurrence of scratches, and the chatter of the cleaning blade (noise). There are some cases where such problems are desired to be solved by improving not the development system or cleaning system but the composition of the photoreceptor. Meanwhile, if the problems can be solved by the improvement of the photoreceptor composition, the development systems and cleaning systems according to conventional techniques can be used as such, and thus the aforementioned solution is advantageous also from the standpoint of cost.

Even in the compositional improvements in photoreceptors, there are various limitations. For example, in a case where the electrical responsiveness of the photoreceptor is desired to be enhanced in order to satisfy the requirement for an increase in speed, a usual technique is to increase the ratio of a charge transport substance in the photosensitive layer to a binder resin (refer PTL 1). However, the resultant photosensitive layer is likely to wear and is unable to satisfy the requirement for high durability. As such, the performances are inconsistent in the design of the photoreceptor compositions. Consequently, a key to development is how to solve the problem and satisfy the required performances.

Under such a circumstance, in order to satisfy the requirement for the high durability, a technique of improving the surface physical properties of the photoreceptor by using a polyarylate resin for the photosensitive layer, and adding a compound having small molecular weight thereto without applying an adverse effect to the electrical properties (refer to PTL 2).

CITATION LIST

Patent Literature

[PTL 1] JP-A-61-270765
[PTL 2] JP-A-2011-170041

SUMMARY OF INVENTION

Technical Problem

However, particularly, in high-end models with long service life and high speed, as the load applied to the photoreceptor is large, dependency with respect to the photoreceptor in the abrasion resistance and the electrical properties after abrasion becomes larger, and thus the photoreceptor having higher level of the electrical properties and the abrasion resistance has been required. In other words, an object of the present invention is to provide an electrophotographic photoreceptor having remarkably excellent abrasion resistance while maintaining the residual potential, a cartridge using the electrophotographic photoreceptor, and an image forming apparatus.

Solution to Problem

The present inventors diligently made investigations. As a result, the inventors have found that it is possible to realize the remarkably excellent abrasion resistance while maintaining the residual potential, with a photoreceptor including a photosensitive layer which contains a charge transport substance, a binder resin, and a compound having a specific structure. The invention has been thus completed as follows.

The summary of the present invention is based on the following <1> to <11>.

<1> An electrophotographic photoreceptor comprising: a conductive support; and a photosensitive layer on the conductive support, wherein the photosensitive layer contains a charge transport substance, a binder resin, and a compound which has a molecular weight of equal to or less than 350, and is represented by General Formula (1):

Formula (1)

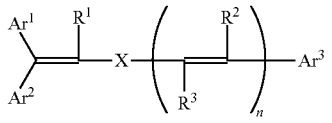

(in Formula (1), $Ar^1$ and $Ar^2$ each independently represent at least one group selected from the group consisting of a hydrogen atom, an alkyl group, a phenyl group which may have a substituent, a naphthyl group which may have a substituent, and an anthracenyl group which may have a substituent, $Ar^3$ represents an aryl group which may have a substituent, $R^1$ to $R^3$ each independently represent at least one group selected from the group consisting of a hydrogen atom, an alkyl group, and a phenyl group which may have a substituent, X represents a phenylene group which may have a substituent, a naphthylene group, or a single bond, n represents an integer in a range of 0 to 3, and at least one of $Ar^1$ and $Ar^2$ is at least one group selected from the group consisting of a phenyl group which may have a substituent, a naphthyl group which may have a substituent, and an anthracenyl group which may have a substituent and $Ar^1$ and $Ar^2$ may be bonded via a carbon atom, an oxygen atom or a sulfur atom, or directly bonded to each other to form a ring).

<2> The electrophotographic photoreceptor according to the <1>, wherein the charge transport substance is a triarylamine derivative or an enamine derivative.

<3> The electrophotographic photoreceptor according to the <1> or <2>, wherein the photosensitive layer contains a compound represented by the General Formula (1) in an amount of 1 part by mass to 30 parts by mass with respect to 100 parts by mass of the binder resin.

<4> The electrophotographic photoreceptor according to any one of the <1> to <3>, wherein the molecular weight of the charge transport substance is equal to or greater than 450.

<5> The electrophotographic photoreceptor according to any one of the <1> to <4>, wherein the elastic deformation rate of the photosensitive layer is equal to or greater than 40%.

<6> The electrophotographic photoreceptor according to any one of the <1> to <5>, wherein the universal hardness of the photosensitive layer is equal to or greater than 145 $N/mm^2$.

<7> An electrophotographic photoreceptor cartridge comprising: the electrophotographic photoreceptor according to any one of the <1> to <6>; and at least one selected from the group consisting of a charging device that charges the electrophotographic photoreceptor, an exposure device that exposes the charged electrophotographic photoreceptor so as to form an electrostatic latent image, and a developing device that develops the electrostatic latent image formed on the electrophotographic photoreceptor.

<8> A full color image forming apparatus comprising:

the electrophotographic photoreceptor according to any one of the <1> to <6>;

a charging device that charges the electrophotographic photoreceptor;

an exposure device that exposes the charged electrophotographic photoreceptor so as to form an electrostatic latent image; and a developing device that develops the electrostatic latent image formed on the electrophotographic photoreceptor.

<9> An electrophotographic photoreceptor comprising: a conductive support; and a photosensitive layer on the conductive support, wherein the photosensitive layer contains a charge transport substance, a binder resin and an additive, the charge transport substance is a triarylamine derivative or an enamine derivative, in which HOMO energy level E_homo obtained as a result of structural optimization calculation based on a density functional calculation B3LYP/6-31G (d,p) satisfies the following expression:

$$E_homo \geq -4.67 \text{ (eV)},$$

and polarizability $\alpha_{calc}$ obtained from the result of HF/6-31G (d,p) calculation after a structural optimization calculation using the B3LYP/6-31G (d,p) of the charge transport substance satisfies the following expression:

$$\alpha_{calc} > 70 \text{ (Å}^3\text{)},$$

the content of the additive is in a range of 0.5 parts by mass to 30 parts by mass with respect to 100 parts by mass of the binder resin, and in the additive, the HOMO energy level E_homo obtained as a result of structural optimization calculation based on a density functional calculation B3LYP/6-31G (d,p) satisfies the following expression:

$$E_homo < -4.9 \text{ (eV)},$$

and dipole moment $\mu_{calc}$ and polarizability $\alpha_{calc}$ obtained from the result of HF/6-31G (d,p) calculation after a structural optimization calculation using the B3LYP/6-31G (d,p) of the additive satisfies the following expression:

$$1.10 \geq \mu_{calc} \text{ (debye)} \geq 0.02 \text{ and}$$

$$42 \geq \alpha_{calc} \text{ (Å}^3\text{)} \geq 28.$$

<10> The electrophotographic photoreceptor as described in <9>, the HOMO energy level E_homo, the dipole moment $\mu_{calc}$ and the polarizability $\alpha_{calc}$ of the additive each satisfy the following expressions:

$$E_homo < -5.1 \text{ (eV)},$$

$$0.40 \geq \mu_{calc} \text{ (debye)} \geq 0.05, \text{ and}$$

$$40 \geq \alpha_{calc} \text{ (Å}^3\text{)} \geq 33.$$

<11> An electrophotographic photoreceptor comprising: a conductive support; and a photosensitive layer on the conductive support, wherein the photosensitive layer contains a charge transport substance, a binder resin and an additive having a molecular weight of equal to or less than 350, the charge transport substance is a triarylamine derivative or an enamine derivative in which HOMO energy level E_homo obtained as a result of structural optimization calculation based on a density functional calculation B3LYP/6-31G (d,p) satisfies the following expression:

$$E_homo \geq -4.67 \text{ (eV)},$$

and polarizability $\alpha_{calc}$ obtained from the result of HF/6-31G (d,p) calculation after a structural optimization calculation using the B3LYP/6-31G (d,p) of the first charge transport substance satisfies the following expression:

$$\alpha_{calc} > 70 \text{ (Å}^3\text{)},$$

the content of the additive is in a range of 0.5 parts by mass to 30 parts by mass with respect to 100 parts by mass of the binder resin, and the additive satisfies an universal hardness of equal to or greater than 155 $N/mm^2$ in the maximum indentation depth when a film of a thickness of 25 μm which contain 10 parts by mass of the additive with respect to 100 parts by mass of polycarbonate resin having the viscosity average molecular weight of 38,000 to 42,000 and indicated by the repeating unit of the following Formula (2), was measured under the conditions of a maximum indentation load of 5 mN, a load-increasing period of 10 s, and a load-removing period for 10 s in the environment of the temperature of 25° C. and the relative humidity of 50% by using a Vickers indenter, and the additive satisfies an elastic deformation rate of equal to or greater than 41.3%:

Formula (2)

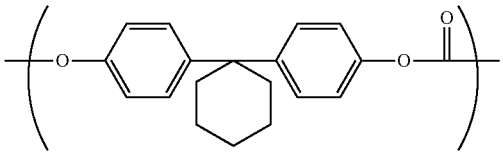

Advantageous Effects of Invention

The present invention is capable of providing an electrophotographic photoreceptor which has remarkably excellent abrasion resistance and ozone resistance while maintaining the residual potential, and can be applied to the high-end models, an electrophotographic photoreceptor cartridge, and a full color image forming apparatus.

DESCRIPTION OF EMBODIMENTS

Figure 1:
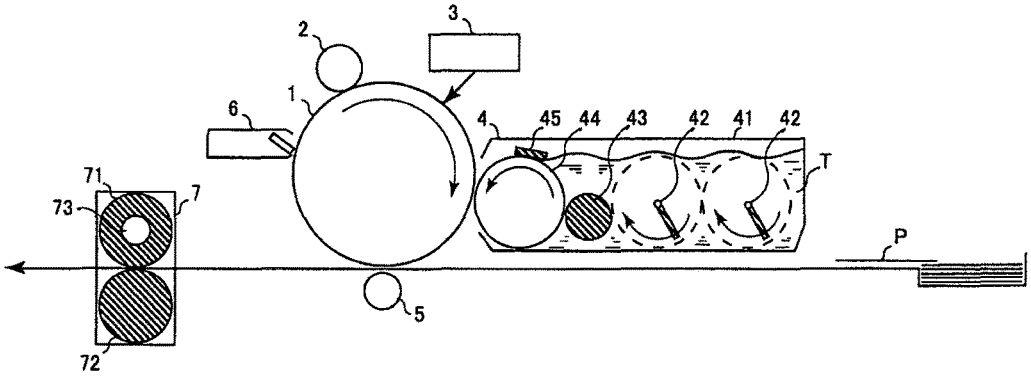
FIG. 1 is a schematic view illustrating a configuration of main portions of one embodiment of an image forming apparatus of the present invention.

Hereinafter, the embodiment of the present invention will be described in detail. Here, the description of the constituent elements described below are representative examples of the embodiment of the present invention and can be performed by appropriately deforming them without departing from the spirit of the present invention. Note that, in the present specification, Me represents a methyl group, Et represents an ethyl group, and t-Bu represents a t-butyl group.

<<Electrophotographic Photoreceptor>>

Hereinafter, a configuration of an electrophotographic photoreceptor of the present invention will be described. The configuration of the electrophotographic photoreceptor of the present invention is not particularly limited as long as it is provided with a photosensitive layer containing a charge transport substance, a binder resin, and a compound (hereinafter, also referred to as an additive) which has a molecular weight of equal to or less than 350 represented by General Formula (1) on a conductive support (on an undercoat layer in a case where the undercoat layer is provided).

In a case where the photosensitive layer of the electrophotographic photoreceptor is of a multilayer type which will be described later, this photoreceptor may be one in which the charge transport layer contains the charge transport substance, the binder resin, and the compound having molecular weight of equal to or less than 350 and optionally further contains additives such as an antioxidant and a leveling agent, if necessary. In addition, in a case where the photosensitive layer of the electrophotographic photoreceptor is of a single-layer type, a charge generation substance and an electron transport substance are generally used besides the ingredients used for the charge transport layer of the multilayer type photosensitive layer.

<Universal Hardness and Elastic Deformation Rate>

The universal hardness of the photosensitive layer is preferably equal to or greater than 145 N/mm$^2$, is further preferably equal to or greater than 150 N/mm$^2$, is still further preferably equal to or greater than 155 N/mm$^2$, and is particularly preferably equal to or greater than 160 N/mm$^2$, from the viewpoint of the abrasion resistance. In addition, from the viewpoint of preventing the shaving during use, it is typically equal to or less than 250 N/mm$^2$, and is preferably equal to or less than 220 N/mm$^2$.

The elastic deformation rate of the photosensitive layer is preferably equal to or greater than 40%, and is further preferably equal to or greater than 43%, from the viewpoint of the filming. From the aspect of the cleaning, it is typically equal to or less than 60%, or preferably equal to or less than 55%.

The universal hardness and the elastic deformation rate are the values measured with microhardness meter (FISCHERSCOPE H100C, manufactured by Fischer) under the environment of the temperature of 25° C. and the relative humidity of 50%. A Vickers square pyramid diamond indenter having a facing angle of 136° is used for the aforementioned measurement. The measurement conditions are set as follows, and the load being imposed on the indenter and the indentation depth under the load were continuously read so as to acquire a profile.

[Measurement Conditions]

Maximum indentation load, 5 mN

Load-increasing period, 10 s

Load-removing period, 10 s

The universal hardness is a value determined through the measurement in which the indenter was forced into the specimen by the maximum indentation load of 5 mN, and is expressed in terms of the value defined by the following equation from the indentation depth (the maximum indentation depth) measured under that load.

Universal hardness (N/mm$^2$)=[test load (N)]/[surface area of the portion of Vickers indenter which penetrated under the test load (mm$^2$)]

The elastic deformation rate of the present invention is the value defined by the following equation, and is the proportion of the amount of the work which the film performs by means of the elasticity thereof during the load removal to the total amount of the work required for the indentation.

$$\text{Elastic deformation rate (\%)}=(We/Wt)\times 100$$

The higher the elastic deformation rate, the less the deformation caused by load remains. The case where the elastic deformation rate is 100 means that no deformation remains.

<Conductive Support>

The conductive support is not particularly limited. Examples of conductive supports mainly used include metallic materials such as aluminum, aluminum alloys, stainless steel, copper, and nickel; resinous materials to which electrical conductivity has been imparted by adding a conductive powder, a metal, carbon, or tin oxide powder; and resins, glasses, and paper, the surface of which has been coated with a conductive material, aluminum, nickel, or ITO (indium-tin oxide), by vapor deposition or coating fluid application. These materials may be used alone, or any desired combination of two or more thereof may be used in any desired proportion. With respect to the form of the conductive support, the conductive support may be in the form of a drum, sheet, belt, or the like. Further, use may be made of a conductive support which is formed of a metallic material and which has been coated with a conductive material having an appropriate resistance value for the purposes of controlling conductivity and the surface properties, and of covering defects.

In the case where a metallic material such as an aluminum alloy is used as a conductive support, this material may be used after an anodized coating is formed thereon. In the case where an anodized coating has been formed, it is desirable to subject the material to a pore-filling treatment by a known method.

The surface of the conductive support may be smooth, or may have been roughened by using a special machining method or by performing a grinding treatment. Alternatively, use may be made of a conductive support having a roughened surface obtained by incorporating particles with an appropriate particle diameter into the material for constituting the support. Furthermore, a drawn pipe can be used as such without subjecting the pipe to machining, for the purpose of cost reduction.

<Undercoat Layer>

An undercoat layer may be disposed between the conductive support and the photosensitive layer which will be described later, in order to improve adhesion, blocking resistance, and the like. As a material of the undercoat layer, for example, a resin or a material in which particles of a metal oxide or the like have been dispersed in a resin can be used. The undercoat layer may be formed of a single layer or a plurality of layers.

Examples of the metal oxide particles used for the undercoat layer include particles of a metal oxide containing one metallic element, such as titanium oxide, indium oxide, tin oxide, aluminum oxide, silicon oxide, zirconium oxide, zinc oxide, iron oxide, or barium sulfate, and particles of a metal oxide containing a plurality of metallic elements, such as calcium titanate, strontium titanate, or barium titanate. Particles of one kind selected from these may be used alone, or particles of two or more kinds may be mixed together and used. Among the metal oxide particles, titanium oxide and aluminum oxide are preferable. Particularly, titanium oxide is preferable.

The titanium oxide particles may be ones of which the surface has been treated with an inorganic substance such as tin oxide, aluminum oxide, antimony oxide, zirconium oxide, or silicon oxide or with an organic substance such as stearic acid, a polyol, or siloxane. As the crystal form of the titanium oxide particles, any of rutile, anatase, brookite, and amorphous ones is usable. Furthermore, the titanium oxide particles may include particles in a plurality of crystal states.

In addition, the metal oxide particles having various particle diameters can be used. However, from the viewpoint of the properties and the stability of the fluid, the average primary particle diameter thereof is preferably in a range of 10 nm to 100 nm, and is pare preferably in a range of 10 nm to 50 nm. The average primary particle diameter can be obtained from TEM photographs, and the like.

It is desirable that the undercoat layer should be formed of a binder resin and metal oxide particles dispersed therein. Examples of the binder resin used for the undercoat layer include known binder resins such as an epoxy resin, a polyethylene resin, a polypropylene resin, an acrylic resin, a methacrylic resin, a polyamide resin, a vinyl chloride resin, a vinyl acetate resin, a phenolic resin, a polycarbonate resin, a polyurethane resin, a polyimide resin, a vinylidene chloride resin, a polyvinyl acetal resin, a vinyl chloride/vinyl acetate copolymer, a polyvinyl alcohol resin, a polyurethane resin, a polyacrylic resin, a polyacrylamide resin, a polyvinyl pyrrolidone resin, a polyvinyl pyridine resin, a water-soluble polyester resin, a cellulose ester resin such as nitrocellulose, a cellulose ether resin, casein, gelatin, a polyglutamic acid, starch, starch acetate, aminostarch, an organozirconium compound such as a zirconium chelate compound and a zirconium alkoxide compound, an organotitanyl compound such as a titanium chelate compound and a titanyl alkoxide compound, and a silane coupling agent. One of these binder resins may be used alone, or any desired combination of two or more thereof may be used in any desired proportion. The binder resins may be used together with a hardener to give a cured layer. Among those binder resins, a resol-type phenolic resin, an alcohol-soluble copolyamide, a modified polyamide, and the like are preferable, because these resins show satisfactory dispersibility and applicability.

The ratio of the inorganic particles with respect to the binder resins used for the undercoat layer can be selected at will. From the viewpoint of the stability and applicability of the dispersion, however, it is generally preferable to use the inorganic particles in a range of 10% by mass to 500% by mass with respect to the binder resins.

The undercoat layer has any desired thickness unless the effects of the invention are considerably lessened. However, from the viewpoints of improving the electrical properties, suitability for intense exposure, image properties, and suitability for repetitions of the electrophotographic photoreceptor, and improving coating-fluid applicability during preparation, the thickness thereof is typically equal to or greater than 0.01 μm, is preferably equal to or greater than 0.1 μm, and is typically equal to or less than 30 μm or less, and is preferably equal to or less than 20 μm. A known antioxidant and the like may be mixed into the undercoat layer. Pigment particles, resin particles, or the like may be used by being contained in the undercoat layer for the purpose of preventing the occurrence of image defects such as interference fringes, for example.

<Photosensitive Layer>

Examples of types of the photosensitive layer include a photosensitive layer of the single-layer structure in which a charge generation substance and a charge transport substance are present in the same layer so as to be in the state of being dispersed in a binder resin, and a photosensitive layer of the function allocation type (multilayer type) formed of two layers of a charge generation layer in which a charge generation substance is dispersed in the binder resin and a charge transport layer in which a charge transport substance is dispersed in the binder resin. The photosensitive layer may be either of these types.

Examples of the multilayer type photosensitive layer include a normal-stack type photosensitive layer in which a charge generation layer and a charge transport layer are stacked and disposed in this order from the conductive support side, and a reverse-stack type photosensitive layer in which a charge transport layer and a charge generation layer are stacked and disposed in this order from the conductive support side. Although either type can be employed, the normal-stack type photosensitive layer is preferable because this photosensitive layer can exhibit an especially well balanced photoconductivity.

<Charge Generation Layer>

The charge generation layer contains a charge generation substance and usually further contains a binder resin and other ingredients which are used if necessary. Such a charge generation layer can be obtained, for example, by dissolving or dispersing a charge generation substance and a binder resin in a solvent or dispersion medium so as to prepare a coating fluid, and applying this coating fluid on a conductive support (on an undercoat layer in the case where the undercoat layer is disposed), and drying the coating fluid applied.

Examples of the charge generation substance include an inorganic photoconductive such as material selenium and an alloy thereof, and cadmium sulfide, and an organic photoconductive material such as an organic pigment. Among them, the organic photoconductive material is preferable, and the organic pigment is particularly preferable. Examples of the organic pigment include a phthalocyanine pigment, an azo pigment, a dithioketopyrrolopyrrole pigment, a squalene (squarylium) pigment, a quinacridone pigment, an indigo pigment, a perylene pigment, a polycyclic quinone pigment, an anthanthrone pigment, and a benzimidazole pigment. Among them, the phthalocyanine pigment or the azo pigment is particularly preferable. In a case where the organic pigment is used as the charge generation substance, typically, fine particles of the organic pigments are used in the form of a dispersed layer bonded with various binder resins.

In a case where the phthalocyanine pigment is used as the charge generation substance, specific examples thereof include materials having various crystal forms of phthalocyanines in which metal-free phthalocyanine, metal such as copper, indium, gallium, tin, titanium, zinc, vanadium, silicon, germanium, and aluminum, or oxide, halide, hydroxide, and alkoxide of the metal are coordinated, and phthalocyanine dimers using an oxygen atom or the like as a cross-linking atom. Particularly, an X form with high sensitivity, a ι-form metal-free phthalocyanine, titanyl phthalocyanines (alternative name: oxytitanium phthalocyanine) such as A form (also known as a β form), a B form (also known as an α form), or a D form (also known as a Y form), vanadyl phthalocyanine, chloroindium phthalocyanine, hydroxy indium phthalocyanine, II-form chlorogallium phthalocyanine, V-form hydroxygallium phthalocyanine, G-form or I-form μ-oxo-gallium phthalocyanine dimer, or II-form μ-oxo-aluminum phthalocyanine dimer is preferable.

In addition, among the aforementioned phthalocyanines, metal phthalocyanine is preferable, and the A form (also known as the β form), the B form (also known as the α form), and the D form (Y form) titanyl phthalocyanine in which a diffraction angle 2θ (±0.2°) of powder X-ray diffraction having an obvious peak at an angle at 27.1° or 27.3°, the II-form chlorogallium phthalocyanine, the V-form hydroxygallium phthalocyanine, hydroxygallium phthalocyanine which has the most intense peak at an angle of 28.1°, or hydroxygallium phthalocyanine which has an obvious peak at an angle of 28.1° without having a peak at angle of 26.2° and in which a half value width W at angle of 25.9° is in a range of $0.1° \leq W \leq 0.4°$, and a G-form μ-oxogallium phthalocyanine dimer are further preferable, and among them, the II-form chlorogallium phthalocyanine and the V-form hydroxygallium phthalocyanine of gallium-based phthalocyanine, hydroxygallium phthalocyanine which has the most intense peak at an angle of 28.1°, or hydroxygallium phthalocyanine which has an obvious peak at an angle of 28.1° without having a peak at angle of 26.2° and in which a half value width W at angle of 25.9° is in a range of $0.1° \leq W \leq 0.4°$, and a G-form μ-oxogallium phthalocyanine dimer are particularly preferable.

In the case where a metal-free phthalocyanine compound or a metal-containing phthalocyanine compound is used as the charge generation substance, it is possible to obtain the photoreceptor with high sensitivity with respect to a laser beam having relatively long wavelength, for example, a laser beam having a wavelength in the vicinity of 780 nm. In addition, in a case of using an azo pigment such as monoazo, diazo or trisazo, it is possible to obtain a photoreceptor having sufficient sensitivity with respect to white light, a laser beam having a wavelength in the vicinity of 660 nm, or a laser beam having relatively short wavelength (for example, a laser beam having a wavelength in a range of 380 nm to 500 nm).

A single phthalocyanine compound may be used alone, or a mixture of some phthalocyanine compounds or a mixture of some crystal states may be used. This mixed state of phthalocyanine compounds or of crystal states to be used here may be a mixture obtained by mixing the components prepared beforehand, or may be a mixture which came into the mixed state during phthalocyanine compound production/treatment steps such as synthesis, pigment formation, and crystallization. Known as such treatment steps include an acid paste treatment, grinding, solvent treatment, and the like. Examples of methods for obtaining a mixed-crystal state include a method in which two kinds of crystals are mixed, subsequently mechanically ground to render the crystals amorphous, and then subjected to a solvent treatment to convert into specific crystal states, as described in JP-A-10-48859.

Meanwhile, in the case of using an azo pigment as the charge generation substance, various conventionally known azo pigments can be used so long as the azo pigments have sensitivity to the light source for light input. However, various kinds of bisazo pigments and trisazo pigments are suitable.

In the case where one or more of the organic pigments shown above as examples are used as the charge generation substance, two or more pigments may be used as a mixture thereof although one of the azo pigments may be used alone. In this case, it is preferable that two or more charge generation substances which have spectral sensitivity characteristics in different spectral regions, i.e., the visible region and the near-infrared region, should be used in combination. More preferred of such methods is to use a disazo pigment or trisazo pigment and a phthalocyanine pigment in combination.

The binder resin used for the charge generation layer is not particularly limited. Examples thereof include insulating resins such as a polyvinyl acetal resin, for example, a polyvinyl butyral resin, a polyvinyl formal resin, and a partly acetalized polyvinyl butyral resin in which the butyral moieties have been partly modified with formal, acetal, or the like, a polyarylate resin, a polycarbonate resin, a polyester resin, a polyarylate resin, a modified ether-type polyester resin, a phenoxy resin, a polyvinyl chloride resin, a polyvinylidene chloride resins, a polyvinyl acetate resin, a polystyrene resin, an acrylic resin, a methacrylic resin, a polyacrylamide resin, a polyamide resin, a polyvinylpyridine resin, a cellulosic resin, a polyurethane resin, an epoxy resin, a silicon resin, a polyvinyl alcohol resin, a polyvinylpyrrolidone resin, casein, copolymers based on vinyl chloride and vinyl acetate, for example, vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicon-alkyd resins, and phenol-formaldehyde resins; and organic photoconductive polymers such as poly-N-vinylcarbazole, polyvinylanthracene, and polyvinylperylene. Any one of these binder resins may be used alone, or any desired combination of two or more thereof may be used as a mixture thereof.

Specifically, the charge generation layer is formed in such a manner that the coating fluid is prepared by dispersing the charge generation substance in a solution obtained by dissolving the above-described binder resin in an organic solvent, and applying the coating fluid on a conductive support (on an undercoat layer in a case of providing the undercoat layer).

In the charge generation layer, regarding the mixing ratio (the mass ratio) of the charge generation substance to the binder resin, the charge generation substance is typically equal to or greater than 10 parts by mass, and is preferably equal to or greater than 30 parts by mass from the viewpoint of the sensitivity, and is typically equal to or less than 1000 parts by mass, and is preferably equal to or less than 500 parts by mass from the viewpoint of the stability of the coating fluid, with respect to 100 parts by mass of the binder resin. The film thickness of the charge generation layer is typically equal to or greater than 0.1 μm, and is preferably equal to or greater than 0.15 μm, and is typically equal to or less than 10 μm, and is preferably equal to or less than 0.6 μm.

Examples of the method dispersing the charge generation substance include known dispersion methods such as a ball mill dispersion method, an attritor dispersion method or a sand mill dispersion method. At this time, it is effective in miniaturizing the particle such that a particle size is preferably equal to or less smaller 0.5 μm, is further preferably equal to or less smaller 0.3 μm, and is still further preferably equal to or less smaller 0.15 μm.

<Charge Transport Layer>

The charge transport layer contains a charge transport substance, a binder resin, a compound (hereinafter, also referred to as an additive) which has a molecular weight of equal to or less than 350 represented by Formula (1), and other components which are used if necessary. Specifically, such a charge transport layer is obtained by preparing the coating fluid obtained by dissolving or dispersing the above-described three components and other components in a solvent, applying the coated fluid on the charge generation layer, and then drying the coated film.

[Compound Having Molecular Weight of Equal to or Less than 350]

As the compound added to the photosensitive layer of the present invention, any compound may be employed as long as the compound has a molecular weight of equal to or less than 350, represented by following Formula (1).

Formula (1)

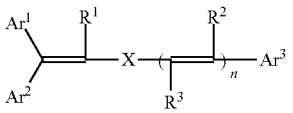

In Formula (1), $Ar^1$ and $Ar^2$ each independently represent at least one group selected from the group consisting of a hydrogen atom, an alkyl group, a phenyl group which may have a substituent, a naphthyl group which may have a substituent, and an anthracenyl group which may have a substituent, $Ar^3$ represents an aryl group which may have a substituent, $R^1$ to $R^3$ each independently represent at least one group selected from the group consisting of a hydrogen atom, an alkyl group, and a phenyl group which may have a substituent, and X represents a phenylene group which may have a substituent, a naphthylene group, or a single bond. n represents an integer in a range of 0 to 3. Here, at least one of $Ar^1$ and $Ar^2$ is at least one group selected from the group consisting of a phenyl group which may have a substituent, a naphthyl group which may have a substituent, and an anthracenyl group which may have a substituent. In addition, $Ar^1$ and $Ar^2$ may be bonded via a carbon atom, an oxygen atom or a sulfur atom, or directly bonded to each other to form a ring.

In the above-described Formula (1), $Ar^1$ and $Ar^2$ each independently represent at least one group selected from the group consisting of a hydrogen atom, an alkyl group, a phenyl group which may have a substituent, a naphthyl group which may have a substituent, and an anthracenyl group which may have a substituent, and at least one of $Ar^1$ and $Ar^2$ is at least one group one selected from the group consisting of a phenyl group which may have a substituent, a naphthyl group which may have a substituent, and an anthracenyl group which may have a substituent. Among them, from the viewpoint of the film physical properties of the photosensitive layer, it is preferable that at least one of $Ar^1$ and $Ar^2$ is a phenyl group which may have a substituent, it is further preferable that both of $Ar^1$ and $Ar^2$ are phenyl groups which may have a substituent, or $Ar^1$ is a phenyl group which may have a substituent, and $Ar^2$ is a naphthyl group which may have a substituent, it is still further preferable that both of $Ar^1$ and $Ar^2$ are phenyl groups which may have a substituent. Note that, each of $Ar^1$ and $Ar^2$ may be directly bonded, or may form a ring structure via a linking group consisting of a carbon atom, an oxygen atom, a nitrogen atom or a sulfur atom. $Ar^3$ represents an aryl group which may have a substituent, and examples of the aryl group include a phenyl group, a naphthyl group, or an anthracenyl group.

In the above-described Formula (1), $R^1$ to $R^3$ each independently represent a hydrogen atom, an alkyl group, or a phenyl group which may have a substituent, and among them, it is preferable that the hydrogen atom and the alkyl group are employed, it is further preferable that at least one of $R^1$ to $R^3$ is a hydrogen atom, and it is still further preferable that at least two of $R^1$ to $R^3$ are hydrogen atoms. X represents a phenyl group which may have a substituent, a naphthyl group, and a single bond. From the viewpoint of the film physical properties of the photosensitive layer, the single bond is preferable. n represents an integer in a range of 0 to 3, is preferably an integer in a range of 0 to 2, and is further preferably an integer of 0 or 1, from the viewpoint of the solubility and compound stability.

Examples of the substituent that $Ar^1$ to $Ar^3$, $R^1$ to $R^3$, and X may have include an alkyl group, an alkoxy group, or a halogen atom. Specifically, examples of the alkyl group include a linear alkyl group such as a methyl group, an ethyl group, an n-propyl group, and an n-butyl group, a branched alkyl group such as an isopropyl group and an ethylhexyl group, and a cyclic alkyl group such as a cyclohexyl group. Examples of the alkoxy group include a linear alkoxy group such as a methoxy group, an ethoxy group, an n-propoxy group, and an n-butoxy group, a branched alkoxy group such as an isopropoxy group and an ethylhexyloxy group, and a cyclic alkoxy group such as a cyclohexyloxy group. Examples of the halogen atom include a fluorine atom, a chlorine atom, and a bromine atom. Among these substituents, from the viewpoint of the versatility of raw materials, the alkyl group having 3 or less carbon atoms, the alkoxy group, the chlorine atom, or the fluorine atom is preferable, the methyl group or the fluorine atom is further preferable, and the methyl group is still further preferable.

The compound represented by the above-described Formula (1) typically has molecular weight of equal to or less than 350. From the viewpoint of the abrasion resistance and the electrical properties, the molecular weight is preferably equal to or less than 340, is further preferably equal to or less than 330, and still further preferably equal to or less than 320. In addition, from the viewpoint of the abrasion resistance, the molecular weight is typically equal to or greater than 200, is preferably equal to or greater than 210, is further preferably equal to or greater than 220, and is still further preferably equal to or greater than 230.

Thereinafter, the structure of the compound represented by the above-described Formula (1), which is suitable for the present invention, will be described. The following structure is merely an example for specifically describing the present invention, and the structure of the compound is not limited to the following structure as long as it does not depart from the concept of the present invention.

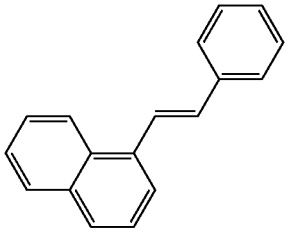

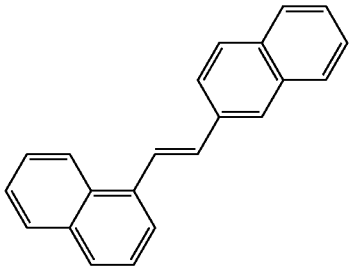

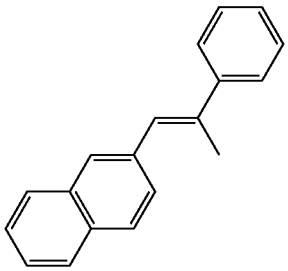

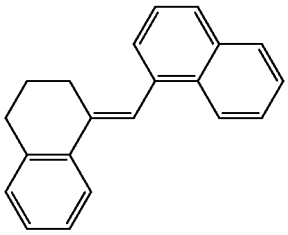

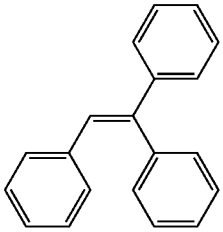

-continued

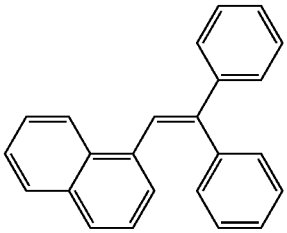

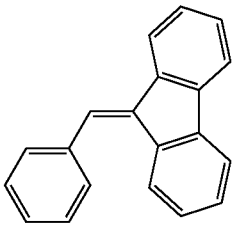

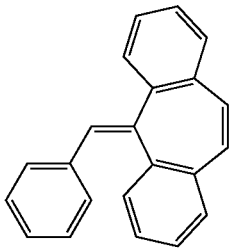

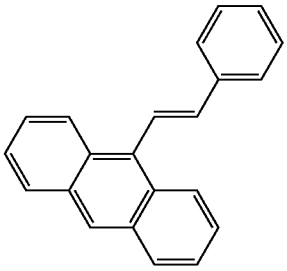

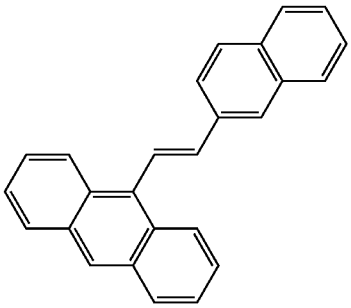

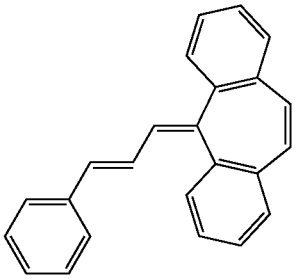

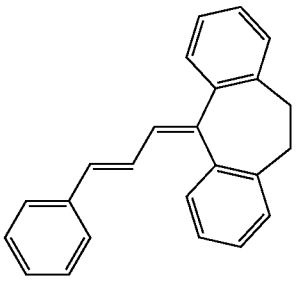

-continued
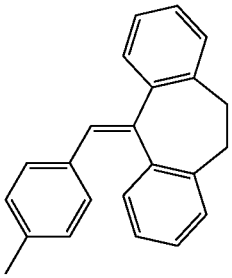
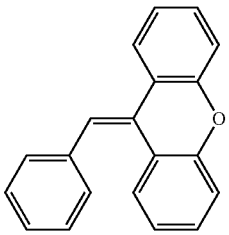
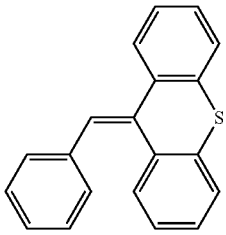
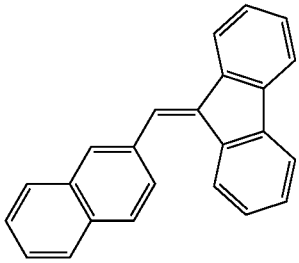
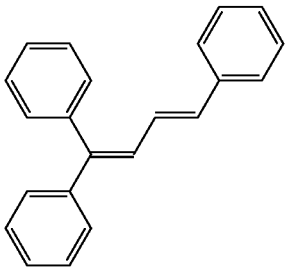
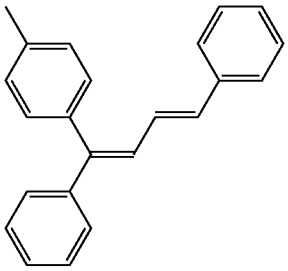
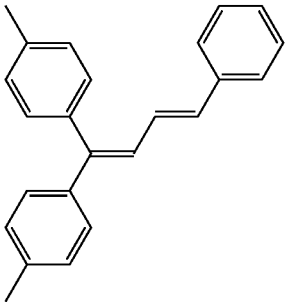
-continued
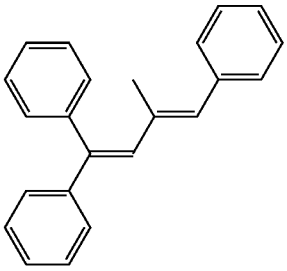
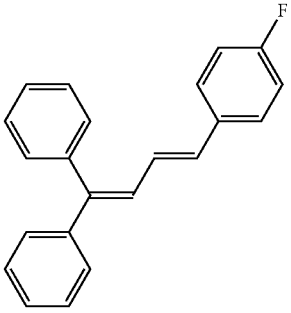
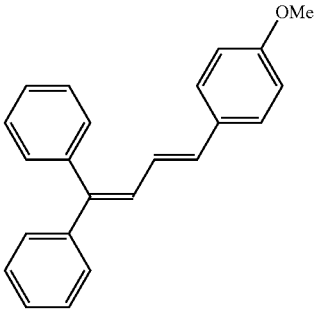
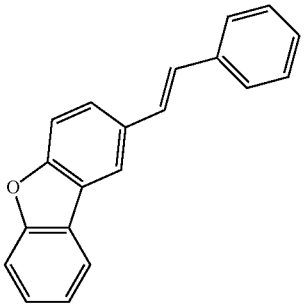
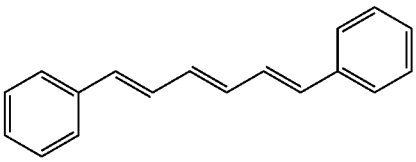
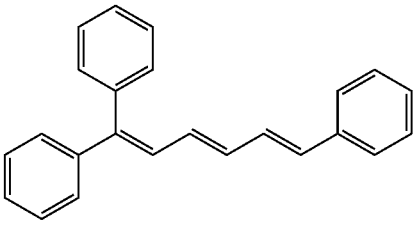

-continued

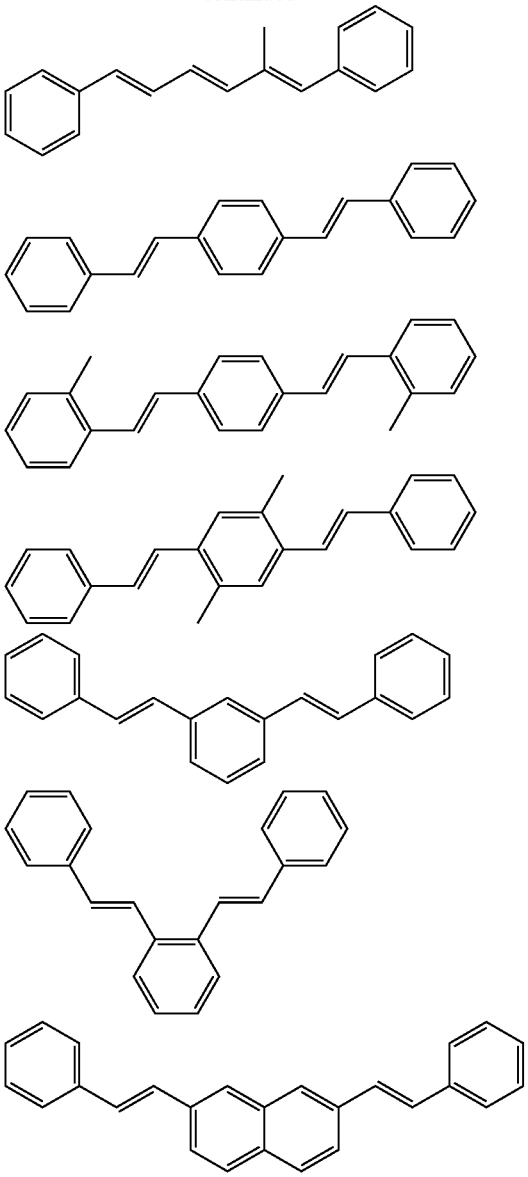

From the viewpoint of the abrasion resistance, the content of the compound represented by the above-described Formula (1) in the photosensitive layer is typically equal to or greater than 0.5 parts by mass, is preferably equal to or greater than 1 part by mass, and is further preferably equal to or greater than 3 parts by mass. From the viewpoint of the residual potential, the content is typically equal to or less than 30 parts by mass, is preferably equal to or less than 25 parts by mass, and is further preferably equal to or less than 15 parts by mass, with respect to 100 parts by mass of binder resin.

(Energy Level of HOMO E_Homo of Compound Having Molecular Weight of Equal to or Less than 350)

The HOMO energy level E_homo of an additive which is the compound having the molecular weight of equal to or less than 350, represented by the above-described Formula (1), based on the structural optimization calculation by using B3LYP/6-31G (d,p) preferably satisfies E_homo<−4.9 (eV), and further preferably satisfies E_homo<−5.1 (eV). The high HOMO energy level may become a trap of charge transport, and thus the electric properties of the electrophotographic photoreceptor may deteriorate.

The HOMO energy level E_homo in the present invention was obtained by calculating the stable structure based on the structural optimization calculation by using B3LYP [refer to A. D. Becke, J. Chem. Phys. 98, 5648 (1993), C. Lee, W. Yang, and R. G. Parr, Phys. Rev. B37, 785 (1988), and B. Miehlich, A. Savin, H. Stoll, and H. Preuss, Chem. Phys. Lett. 157, 200 (1989)] which is one of density functional calculation methods. At this time, 6-31G (d,p) obtained by adding polarization functions to 6-31G [refer to R. Ditchfield, W. J. Hehre, and J. A. Pople, J. Chem. Phys. 54, 724 (1971), W. J. Hehre, R. Ditchfield, and J. A. Pople, J. Chem. Phys. 56, 2257 (1972), P. C. Hariharan and J. A. Pople, Mol. Phys. 27, 209 (1974), M. S. Gordon, Chem. Phys. Lett. 76, 163 (1980), P. C. Hariharan and J. A. Pople, Theo. Chim Acta 28, 213 (1973), J.-P. Blaudeau, M. P. McGrath, L. A. Curtiss, and L. Radom, J. Chem. Phys. 107, 5016 (1997), M. M. Francl, W. J. Pietro, W. J. Hehre, J. S. Binkley, D. J. DeFrees, J. A. Pople, and M. S. Gordon, J. Chem. Phys. 77, 3654 (1982), R. C. Binning Jr. and L. A. Curtiss, J. Comp. Chem. 11, 1206 (1990), V. A. Rassolov, J. A. Pople, M. A. Ratner, and T. L. Windus, J. Chem. Phys. 109, 1223 (1998), and V. A. Rassolov, M. A. Ratner, J. A. Pople, P. C. Redfern, and L. A. Curtiss, J. Comp. Chem. 22, 976 (2001)] was used as a basis set. In the present invention, B3LYP calculation using 6-31G (d,p) is denoted as B3LYP/6-31G (d,p).

(Dipole Moment $\mu_{calc}$ and Polarizability $\alpha_{calc}$ of Compound Having Molecular Weight of Equal to or Less than 350)

The dipole moment $\mu_{calc}$ and the polarizability $\alpha_{calc}$ are obtained by a Restricted Hartree-Fock calculation method (refer to "Modern Quantum Chemistry", A. Szabo and N. S. Ostlund, McGraw-Hill publishing company, New York, 1989) in the stable structure obtained by the structural optimization calculation based on the density functional calculation B3LYP/6-31G (d,p) of the additive. At this time, 6-31G (d,p) was used as a basis set. In the present invention, Hartree-Fock calculation using 6-31G (d,p) is denoted as HF/6-31G (d,p).

Examples of programs in which the calculation of the additive in the present invention such as B3LYP/6-31G (d,p) calculation and HF/6-31G (d,p) calculation is used include Gaussian 09 and Revision B.01 (M. J. Frisch, G. W. Trucks, H. B. Schlegel, G. E. Scuseria, M. A. Robb, J. R. Cheeseman, G. Scalmani, V. Barone, B. Mennucci, G. A. Petersson, H. Nakatsuji, M. Caricato, X. Li, H. P. Hratchian, A. F. Izmaylov, J. Bloino, G. Zheng, J. L. Sonnenberg, M. Hada, M. Ehara, K. Toyota, R. Fukuda, J. Hasegawa, M. Ishida, T. Nakajima, Y. Honda, O. Kitao, H. Nakai, T. Vreven, J. A. Montgomery, Jr., J. E. Peralta, F. Ogliaro, M. Bearpark, J. J. Heyd, E. Brothers, K. N. Kudin, V. N. Staroverov, R. Kobayashi, J. Normand, K. Raghavachari, A. Rendell, J. C. Burant, S. S. Iyengar, J. Tomasi, M. Cossi, N. Rega, J. M. Millam, M. Klene, J. E. Knox, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, R. L. Martin, K. Morokuma, V. G. Zakrzewski, G. A. Voth, P. Salvador, J. J. Dannenberg, S. Dapprich, A. D. Daniels, O. Farkas, J. B. Foresman, J. V. Ortiz, J. Cioslowski, and D. J. Fox, Gaussian, Inc., Wallingford Conn., 2009).

When considering the mechanical properties such as film strength of the photosensitive layer or the elastic deformation rate of the photosensitive layer from the viewpoint of molecular theory, it is presumed that the strength of an intermolecular force (van der Waals force) of the combination of the binder resin, the charge transport substance, and the additive which form the photosensitive layer is influenced. The contribution of the additive to the photosensitive layer can be estimated based on the strength of an intermolecular force of the combination of the binder resin, the charge transport substance, and other additives which form the photosensitive layer.

It is considered that the binder resin in the photosensitive layer contains a local dipole moment (local polarization unit) such as a carbonyl group, and a strong alignment force works between the additive having large dipole moment and the local polarization unit of the binder resin. In addition, it is considered that the additive having large polarizability receives greater induction force from the local polarization unit of the binder resin, and the larger dispersive force works between all molecules in the unpolarized surroundings. From the above viewpoint, the dipole moment and the polarizability of the additive are focused on the basis of Non-Patent Document of [Intermolecular and Surface Forces, Second Edition, J. N. Isrealachvili, translated by Tamotsu Kondo and Hiroyuki Oshima, Asakura Publishing Co., Ltd., (1996)], the film strength, the elastic deformation rate, and the ozone resistance properties of the photosensitive layer were analyzed. As a result, it was found that the additive satisfying the following conditions is effective in the electrical properties, the ozone resistance properties, and the abrasion resistance of the electrophotographic photoreceptor.

The dipole moment $\mu_{calc}$ is preferably equal to or greater than 0.02 debye, is further preferably equal to or greater than 0.05 debye, and is still further preferably equal to or greater than 0.10 debye from the viewpoint of the improvement of the hardness and the elastic deformation rate. In addition, the dipole moment $\mu_{calc}$ is preferably equal to or less than 1.10 debye, is further preferably equal to or less than 0.40 debye, and is still further preferably equal to or less than 0.20 debye from the viewpoint of the improvement of the hardness and the elastic deformation rate. When the dipole moment $\mu_{calc}$ is equal to or greater than 0.02 debye, the orientation force is sufficient and the entanglement with the binder resin is sufficient, and thus an effect can be obtained. On the other hand, when the dipole moment $\mu_{calc}$ is equal to or less than 1.10 debye, it is possible to prevent the carrier trap and the electrical properties such as mobility from being deteriorated.

The polarizability $\alpha_{calc}$ is preferably equal to or greater than 28 Å$^3$, and is further preferably equal to or greater than 33 Å$^3$ from the viewpoint of the hardness and the elastic deformation rate. In addition, it is preferably equal to or less than 42 Å$^3$, and is further preferably equal to or less than 40 Å$^3$ from the viewpoint of the hardness and the elastic deformation rate. When the polarizability $\alpha_{calc}$ is equal to or greater than 28 Å$^3$, the induction force from the binder resin becomes sufficient and an effect can be obtained. On the other hand, When the polarizability $\alpha_{calc}$ is equal to or less than 42 Å$^3$, it is possible to prevent the molecular volume from becoming excessively large and the additive is able to enter voids formed on the film of the photosensitive layer, and the effect is sufficient.

(Universal Hardness and Elastic Deformation Rate of Film Containing Compound Having Molecular Weight of Equal to or Less than 350)

It has been known that the surface physical properties such as the universal hardness and the elastic deformation rate of the photosensitive layer which is formed of a polycarbonate resin and a polyester resin, and used in the field of electrophotography affect not only the mechanical properties but also the photoreceptor properties such as the filming and sounding. The universal hardness and the elastic deformation rate can be adjusted by changing the molecular structure of the binder resin, and changing the number of the parts added to the charge transport substance or the molecular structure.

On the other hand, in the above-described methods, the electrical properties are deteriorated, or the abrasion resistance is reduced due to a large amount of the charge transport substances in some cases. Particularly, in a case where the charge transport substance having a large molecular structure with a large molecular structure is used, the universal hardness and the elastic deformation rate are low, and the properties of the photoreceptor tend to be deteriorated such as the deterioration of the mechanical properties and the film properties.

In this regard, in the present invention, it was found that the photoreceptor properties are improved by the additives in which the universal hardness becomes higher due to the addition, and thus the elastic deformation rate is not lowered while maintaining the electrical properties by being used with the charge transport substance. The additive satisfies the following conditions.

Regarding the additive, the universal hardness is preferably equal to or greater than 155 N/mm$^2$, and is further preferably equal to or greater than 160 N/mm$^2$ in the maximum indentation depth when the film which contained 10 parts by mass of polycarbonate resin having the viscosity average molecular weight of 38,000 to 42,000, indicated by the repeating unit of the following Formula (2) respect to 100 parts by mass of polycarbonate resin, and had a thickness of 25 μm was measured under the conditions of a maximum indentation load of 5 mN, a load-increasing period of 10 s, and a load-removing period for 10 s in the environment of the temperature of 25° C. and the relative humidity of 50% by using a Vickers indenter. In addition, the elastic deformation rate thereof is preferably equal to or greater than 41.3%, and is further preferably equal to or greater than 41.5%.

Formula (2)

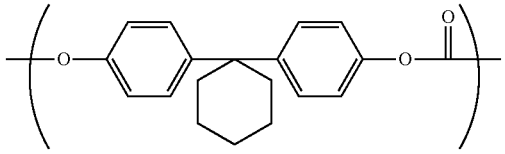

Note that, the polycarbonate resin having the repeating structure represented by the above-described Formula (2) is a polycarbonate resin which is typically used as the binder resin for a charge transport layer of the electrophotographic photoreceptor, and is used as one condition for representing the properties of the additive in the present invention. In addition, it is possible to perform the measurement by using the commercially available polycarbonate resin having the standard viscosity average molecular weight of 40,000. For this reason, as described in the following example of the binder resin, unless departing from the concept of the present invention, the binder resin of the photosensitive layer is not limited to the polycarbonate resin having the repeating unit represents by the above-described Formula (2).

The universal hardness and the elastic deformation rate of the additive are measured under the same conditions at those in the case of the universal hardness and the elastic deformation rate of the photosensitive layer.

Hereinafter, examples of the structures of the additives suitable for the present invention, and each of HOMO energy level E_homo obtained from the result of the structural optimization calculation based on the density functional calculation B3LYP/6-31G (d,p), and the dipole moment $\mu_{calc}$ and the polarizability $\alpha_{calc}$ obtained from the result of the HF/6-31G (d,p) calculation after the structural optimization calculation are indicated in Table 1. The following structures are not limited to the following structure as long as it does not depart from the concept of the present invention.

TABLE 1

| | Structure | Molecular weight | E_homo (eV) | $\mu_{calc}$ (debye) | $\alpha_{calc}$ (Å$^3$) |
|---|---|---|---|---|---|
| AD-1 | 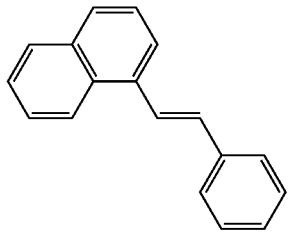 | 230.31 | −5.40 | 0.0409 | 29.035 |
| AD-2 | 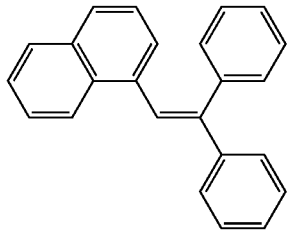 | 306.41 | −5.34 | 0.1355 | 36.814 |
| AD-3 | 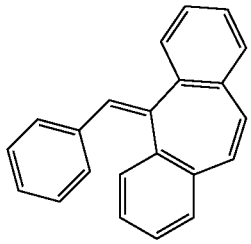 | 280.37 | −5.47 | 0.1034 | 33.429 |
| AD-4 | 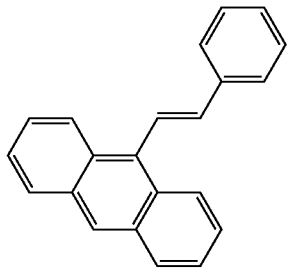 | 280.37 | −5.05 | 0.1360 | 36.659 |
| AD-5 | 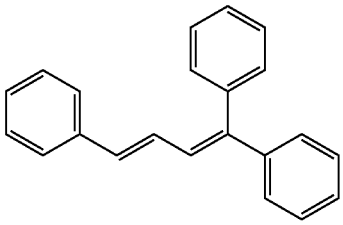 | 282.39 | −5.18 | 0.1439 | 37.637 |

TABLE 1-continued

| | Structure | Molecular weight | E_homo (eV) | $\mu_{calc}$ (debye) | $\alpha_{calc}$ (Å$^3$) |
|---|---|---|---|---|---|
| AD-6 | 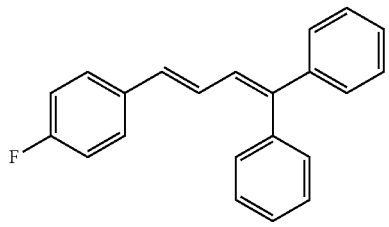 | 300.38 | −5.21 | 0.7692 | 37.553 |
| AD-7 | 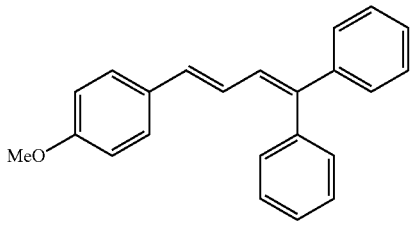 | 312.41 | −4.94 | 0.5778 | 40.838 |
| AD-8 | 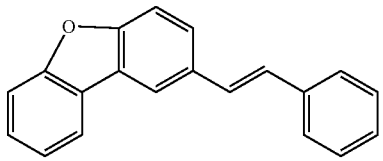 | 270.33 | −5.41 | 0.3791 | 33.265 |
| AD-9 | 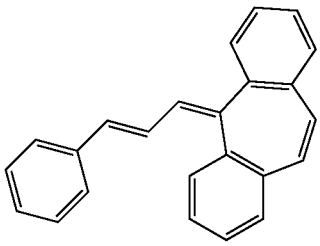 | 306.41 | −5.20 | 0.0844 | 40.508 |
| AD-10 | 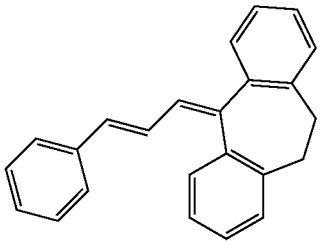 | 308.42 | −5.29 | 0.1921 | 39.454 |

[Charge Transport Substance]

Examples of the charge transport substance include an electron transport substance such as an aromatic nitro compound such as 2,4,7-trinitrofluorenone, a cyano compound such as tetracyanoquinodimethane, and a quinone compound such as diphenoquinone, a heterocyclic compound such as a carbazole derivative, an indole derivative, an imidazole derivative, an oxazole derivative, a pyrazole derivative, a thiadiazole derivative, and a benzofuran derivative, an aniline derivative, a hydrazone derivative, a triarylamine derivative, a stilbene derivative, a butadiene derivative, an enamine derivative, a combination of plural types of these compounds, and a hole transport material such as a polymer having a group composed of these compounds in a main chain or a side chain. Among them, from the viewpoint of the electrical properties, the triarylamine derivative, the enamine derivative, the combination of plural types of these compounds are preferable.

From the viewpoint of the electrical properties and the abrasion resistance, the molecular weight of the charge transport substance is preferably equal to or greater than 450, and is further preferably equal to or greater than 600. From the viewpoint of the solubility, it is typically equal to or less than 1200, and is preferably equal to or less than 1000. Further, in a case where the molecular weight of the charge transport substance is equal to or greater than 450, a void is likely to occur in the photosensitive layer, and thus when the charge transport substance is combined with the additive used in the present invention, an effect of improving the ozone resistance and the universal hardness becomes great. Particularly, the combination effect is great in a case where the molecular weight is equal to or greater than 600.

The specific examples of the structure which is suitable for the charge transport substance will be described blow. These specific examples are shown for the sake of illustration, and any well-known charge transport substance may be used unless contrary to the gist of the present invention. The charge transport substance may be used alone, or any desired combination of two or more thereof may be used in any desired proportion.

HTM1

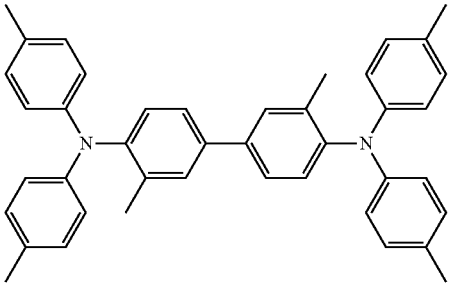

HTM2

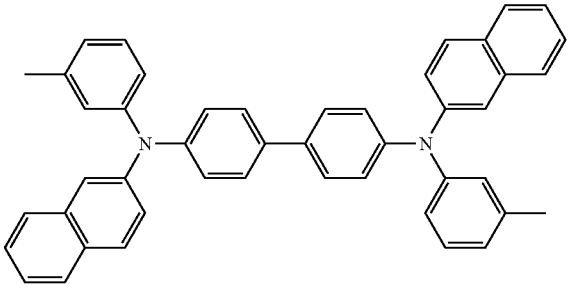

HTM3

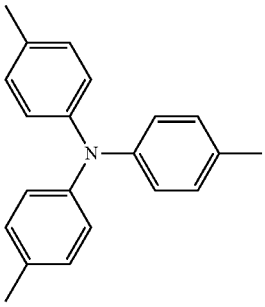

HTM4

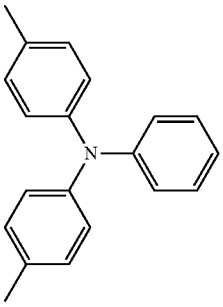

HTM5

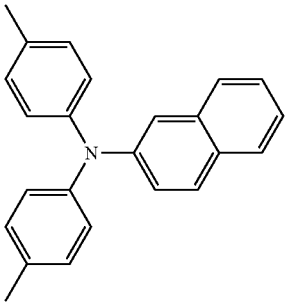

HTM6

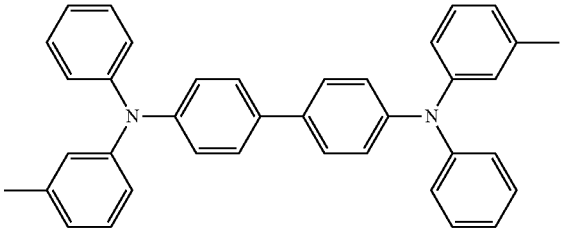

HTM7

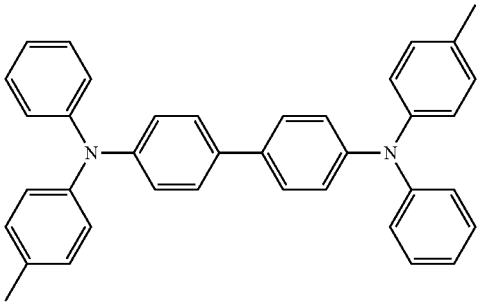

HTM8

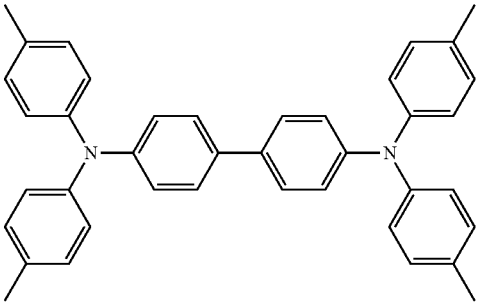

-continued
HTM9
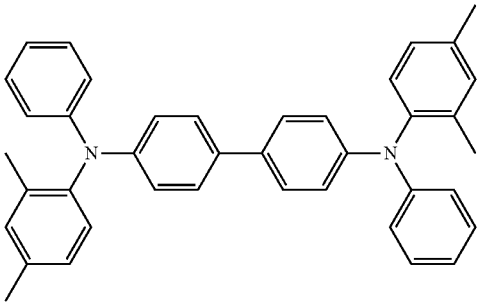
HTM10
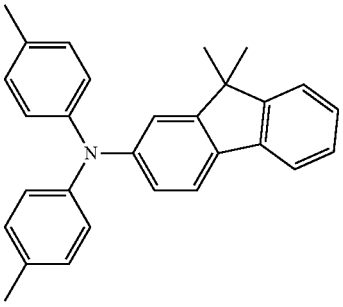
HTM11
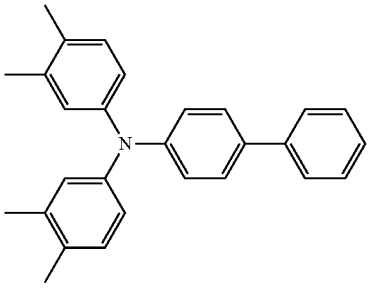
HTM12
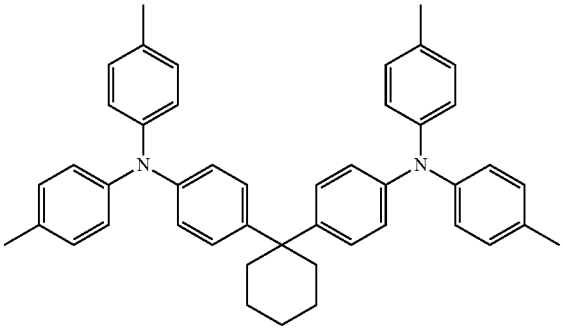
HTM13
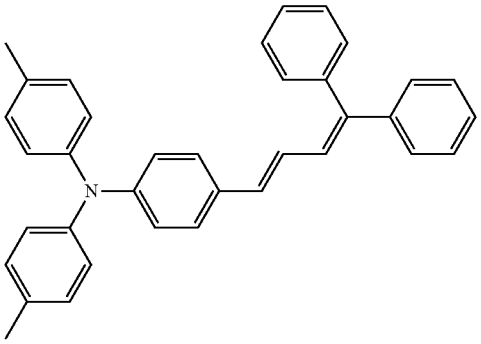
HTM14
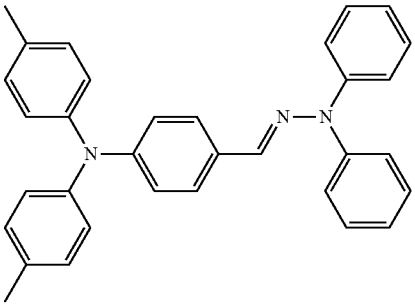
HTM15
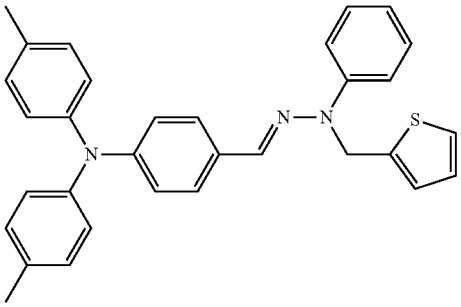
HTM16
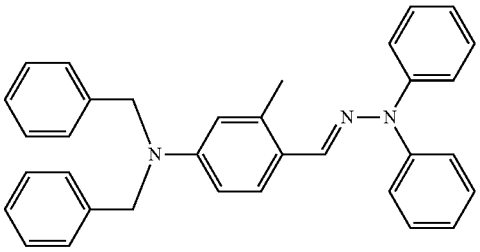

-continued
HTM17
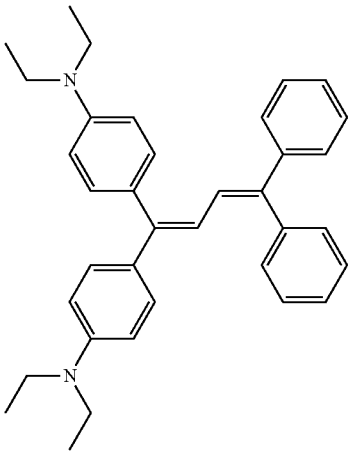
HTM18
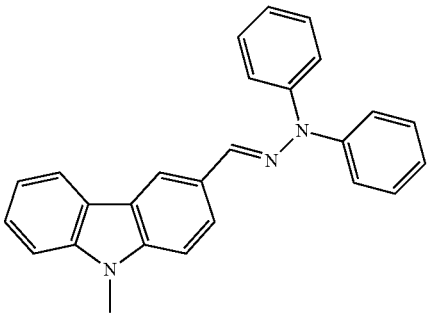
HTM19
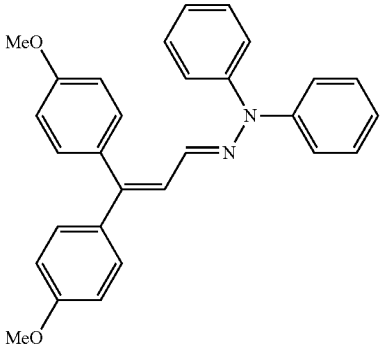
HTM20
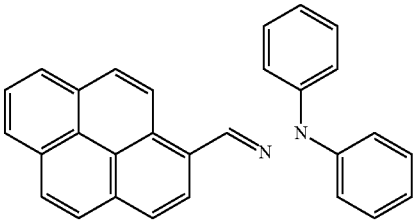
HTM21
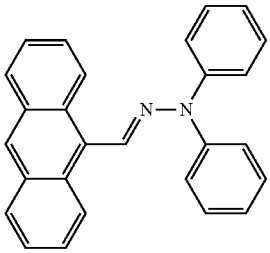
HTM22
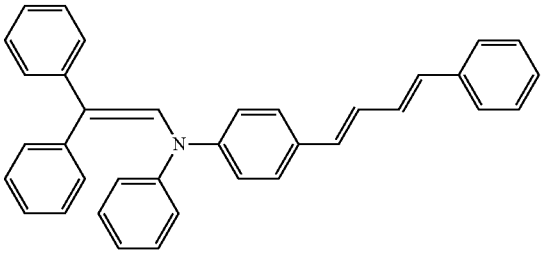
HTM23
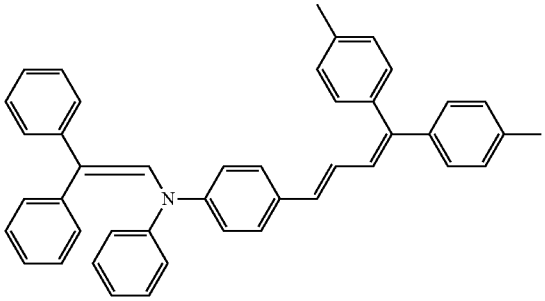
HTM24
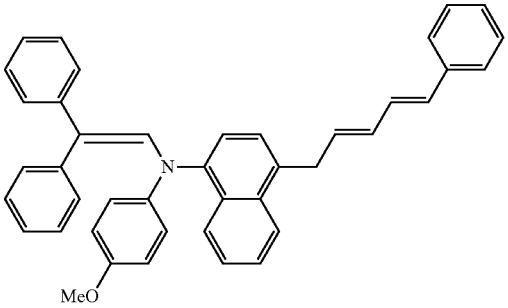

-continued
HTM25
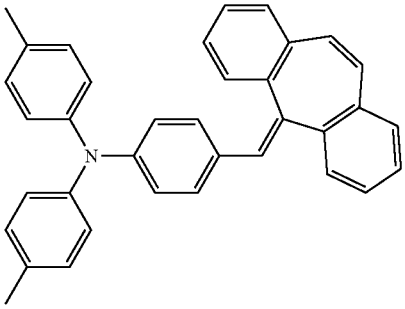
HTM26
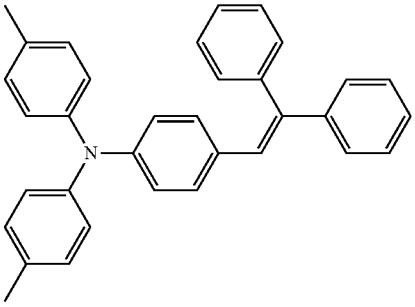
HTM27
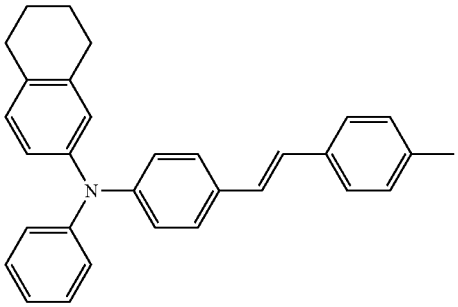
HTM28
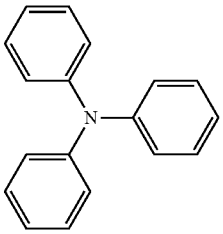
HTM29
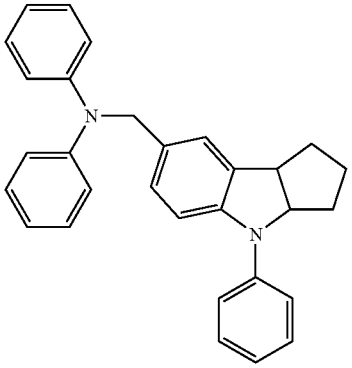
HTM30
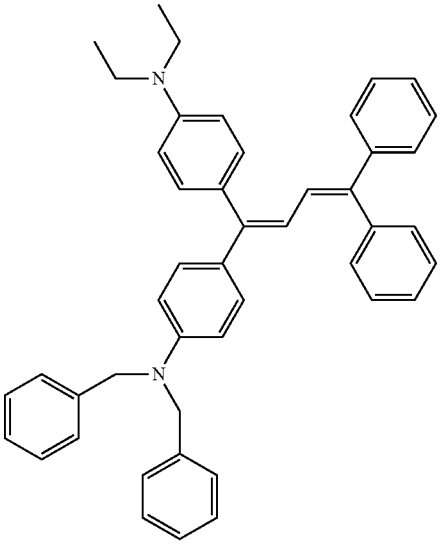
HTM31
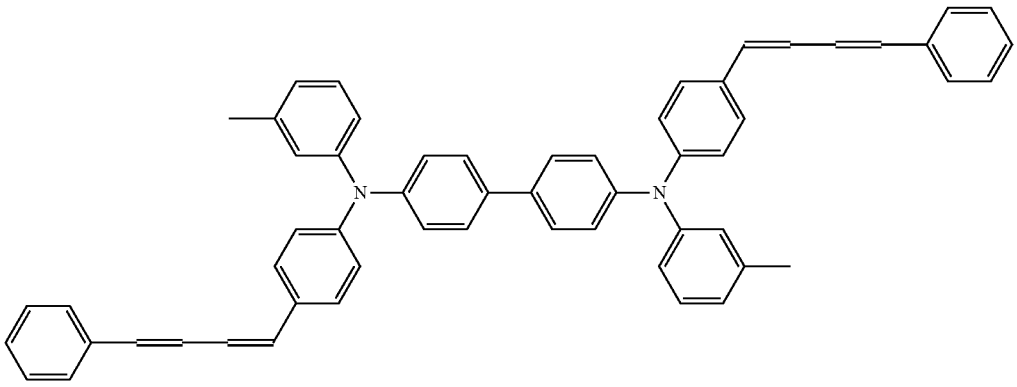

-continued
HTM32
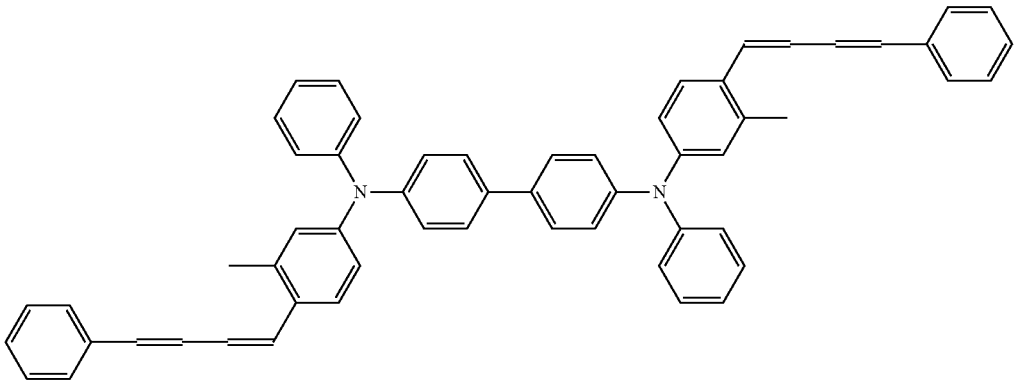
HTM33
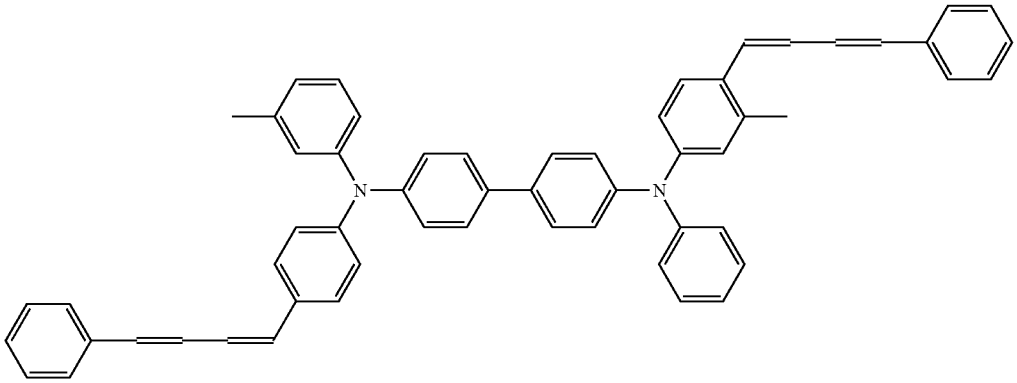
HTM34
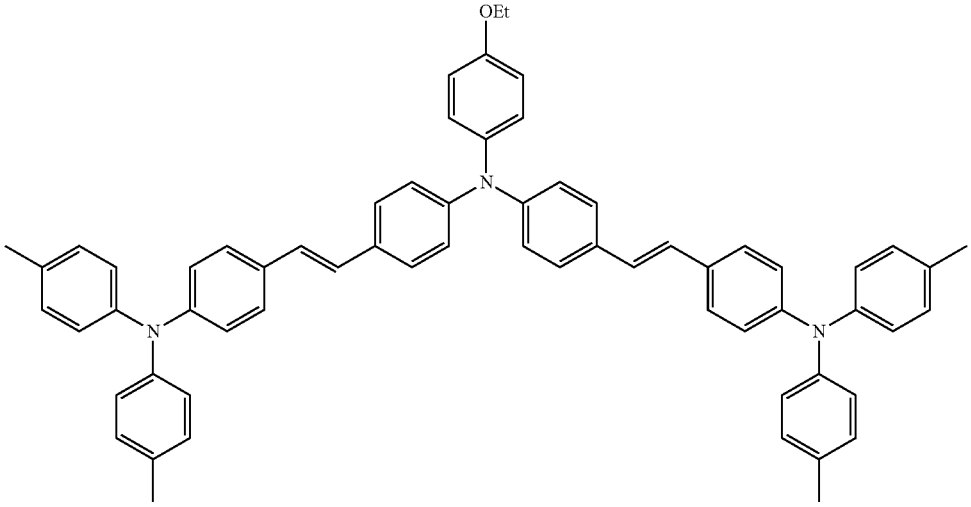

-continued
HTM35
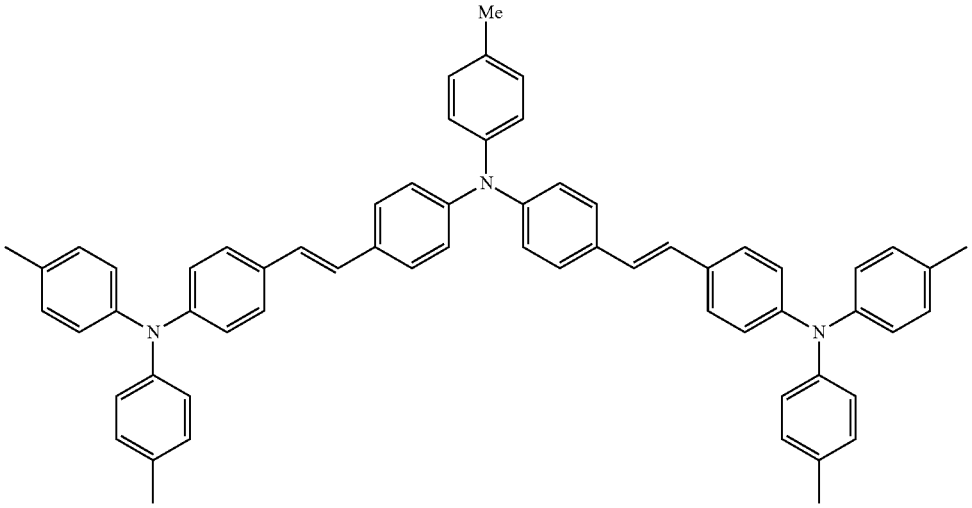
HTM36
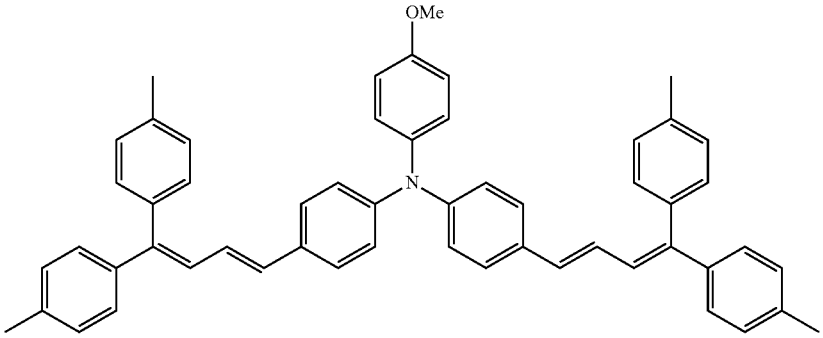
HTM37
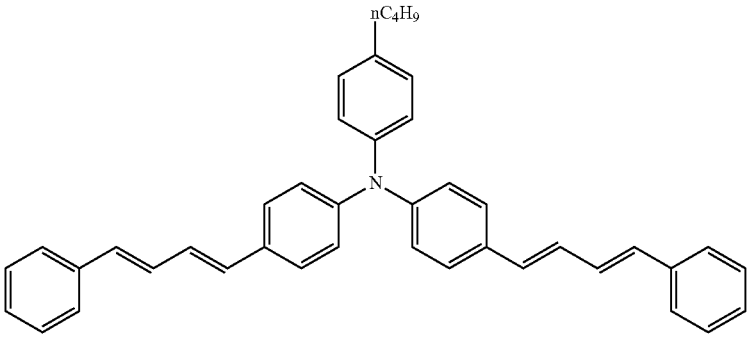
HTM38
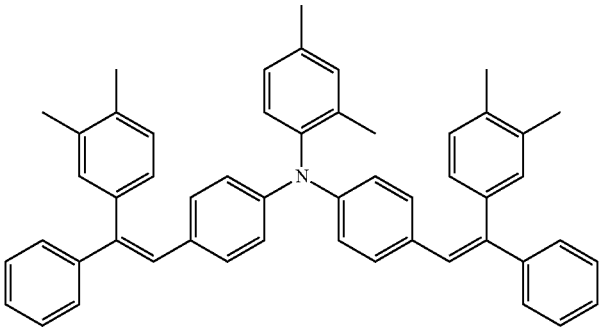

-continued
HTM39
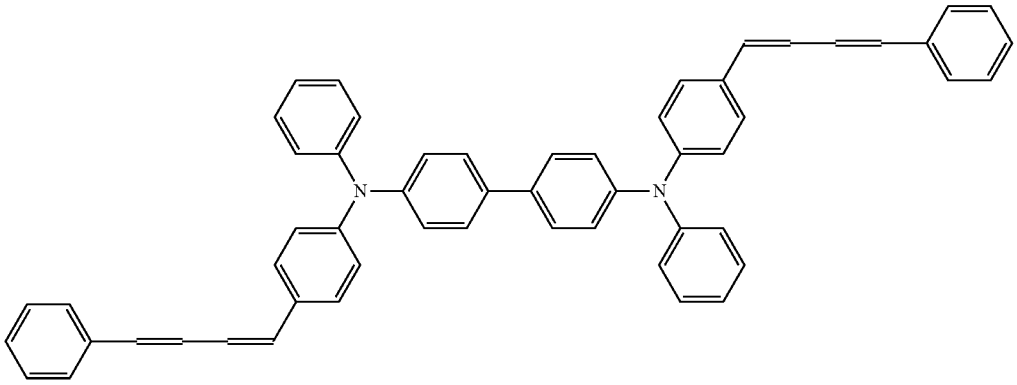
HTM40
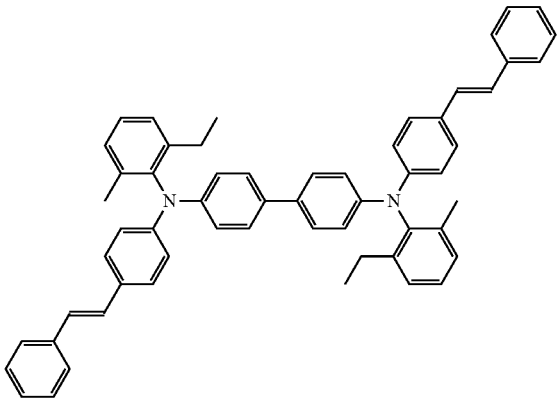
HTM41
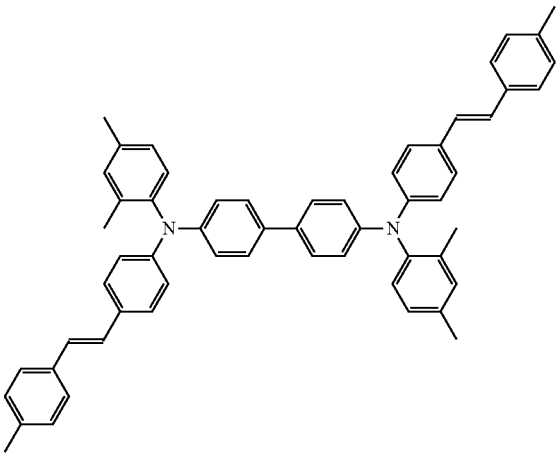
HTM42
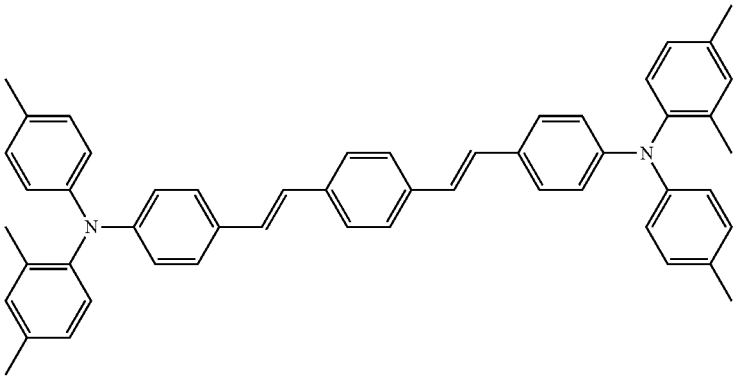
HTM43
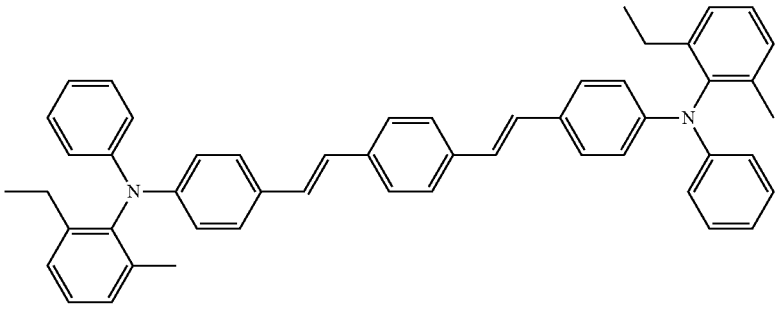

-continued

HTM44

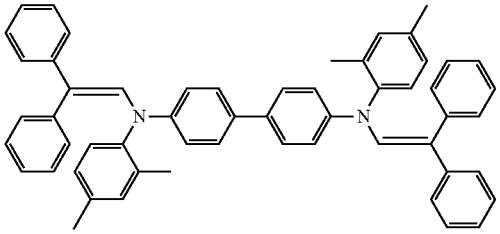

HTM45

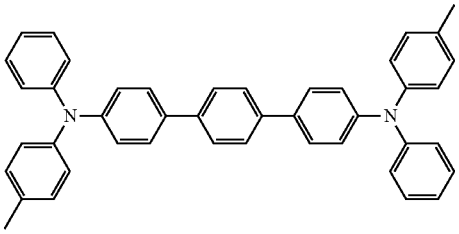

HTM46

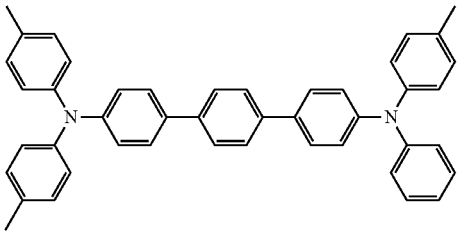

HTM47

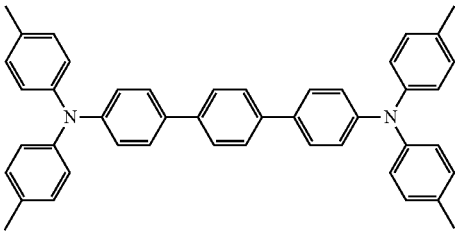

ETM1

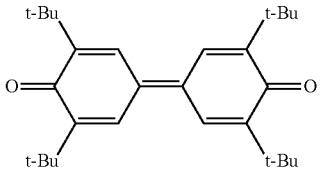

ETM2

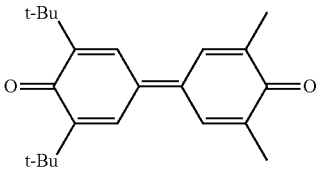

ETM3

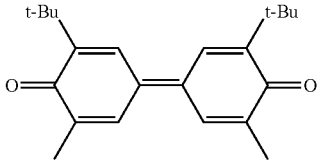

ETM4

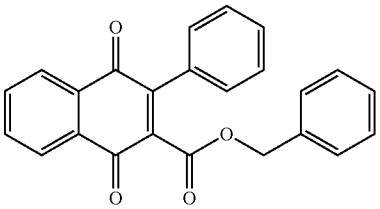

ETM5

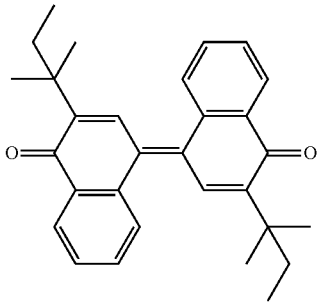

ETM6

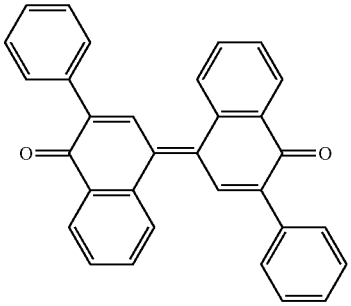

ETM7

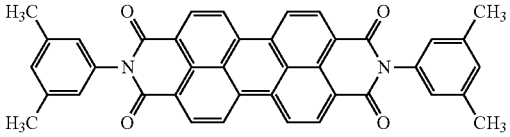

ETM8

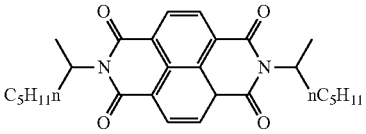

The HOMO energy level E_homo of the charge transport substance of the invention of the present application, which is based on the structural optimization calculation by using the B3LYP/6-31G (d,p), preferably satisfies E_homo≥−4.67 (eV), further preferably satisfies E_homo≥−4.65 (eV), and is particularly preferably satisfies E_homo≥−4.63 (eV). This is because the higher the HOMO energy level is, the better the electrophotographic photoreceptor with the lower potential after exposure is obtained. On the other hand, when the E_homo is excessively high, there are problems such as deterioration of gas resistance and the occurrence of ghosts, and thus, typically relationship expressed by E_homo<−4.20 (eV) is satisfied, and relationship expressed by E_homo<−4.30 (eV) is preferably satisfied.

Further, the polarizability $\alpha_{calc}$ obtained from the result of the HF/6-31G (d,p) calculation after the structural optimization calculation using B3LYP/6-31G (d,p) preferably satisfies $\alpha_{calc}$>70 (Å$^3$), and further preferably satisfies $\alpha_{calc}$>80

(Å$^3$), and particularly preferably satisfies $\alpha_{calc}$>90 (Å$^3$). This is because a charge transport film containing the charge transport substance having a large $\alpha_{calc}$ exhibits high charge mobility and an electrophotographic photoreceptor excellent in chargeability, sensitivity, and the like can be obtained by using the charge transport film. On the other hand, when $\alpha_{calc}$ is excessively large, the solubility of the charge transport substance is deteriorated, and thus it typically satisfies $\alpha_{calc}$<200 (Å$^3$), preferably satisfies $\alpha_{calc}$<150 (Å$^3$), further preferably satisfies $\alpha_{calc}$<130 (Å$^3$), and particularly preferably satisfies $\alpha_{calc}$<110 (Å$^3$).

The charge transport substance satisfying both of E_homo>−4.67 (eV) and $\alpha_{calc}$>70 (Å$^3$) combines advantages of two parameter regulations as described above. Since the charge transport substance has a low potential after exposure and excellent responsiveness, it can be used even with small number of the parts, and thus hard to impair the properties of the binder.

The E_homo of the charge transport substance in the present invention is obtained by calculates the stable structure based on the B3LYP. Further, the polarizability $\alpha_{calc}$ is obtained by the HF/6-31G (d,p) calculation after the structural optimization calculation based on the B3LYP/6-31G (d,p). In the present invention, examples of the programs in which the B3LYP/6-31G (d,p) calculation and the HF/6-31G (d,p) calculation are used include Gaussian 03 and Revision D. 01 (M. J. Frisch, G. W. Trucks, H. B. Schlegel, G. E. Scuseria, M. A. Robb, J. R. Cheeseman, J. A. Montgomery, Jr., T. Vreven, K. N. Kudin, J. C. Burant, J. M. Millam, S. S. Iyengar, J. Tomasi, V. Barone, B. Mennucci, M. Cossi, G. Scalmani, N. Rega, G. A. Petersson, H. Nakatsuji, M. Hada, M. Ehara, K. Toyota, R. Fukuda, J. Hasegawa, M. Ishida, T. Nakajima, Y. Honda, O. Kitao, H. Nakai, M. Klene, X. Li, J. E. Knox, H. P. Ilratchian, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, P. Y. Ayala, K. Morokuma, G. A. Voth, P. Salvador, J. J. Dannenberg, V. G. Zakrzewski, S. Dapprich, A. D. Daniels, M. C. Strain, O. Farkas, D. K. Malick, A. D. Rabuck, K. Raghavachari, J. B. Foresman, J. V. Ortiz, Q. Cui, A. G. Baboul, S. Clifford, J. Cioslowski, B. B. Stefanov, G. Liu, A. Liashenko, P. Piskorz, I. Komaromi, R. L. Martin, D. J. Fox, T. Keith, M. A. Al-Laham, C. Y. Peng, A. Nanayakkara, M. Challacombe, P. M. W. Gill, B. Johnson, W. Chen, M. W. Wong, C. Gonzalez, and J. A. Pople, Gaussian, Inc., Wallingford Conn., 2004.).

The structure of the charge transport material satisfying the parameter of the present invention is a triarylamine derivative and an enamine derivative. Such charge transport materials may be bonded to various types of derivative selected from a stilbene derivative, a butadiene derivative, a hydrazone derivative, a carbazole derivative, and an aniline derivative. Among them, a combination of the enamine derivatives and the triarylamine derivatives is further preferable. In addition, as π-conjugation system is expanded, the $\alpha_{calc}$ tends to be increased, and a structure in which the π-conjugation system is expanded in consideration of the steric effect by the planarity and the substituent is preferable.

Specific examples of the structure suitable for the charge transport substance which satisfies the above-described parameters are indicated in Tables 2 to 4. These specific examples are shown for the sake of illustration, and any well-known charge transport substance may be used unless contrary to the gist of the present invention. In a case of being used with the charge transport substance outside the range of the parameters of the present invention, in order to sufficiently exhibit the above-described invention, the charge transport substance satisfying the parameters of the present invention is typically equal to or greater than 10% by mass, is preferably equal to or greater than 50% by mass, is further preferably equal to or greater than 80% by mass, and is particularly preferably equal to or greater than 100% by mass, with respect to the charge transport substance.

TABLE 2

| Charge transport substance | E_homo (eV) | $\alpha_{cal}$ (Å$^3$) |
|---|---|---|
| 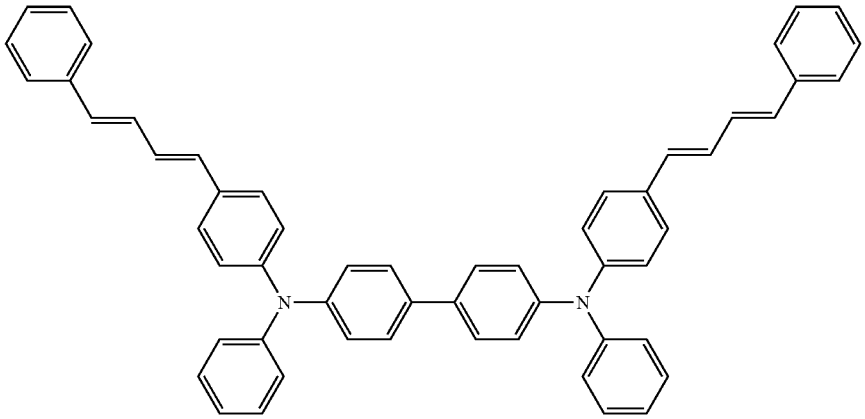 | −4.64 | 110.4 |

TABLE 2-continued
| Charge transport substance | E_homo (eV) | $\alpha_{cal}$ (Å$^3$) |
|---|---|---|
| 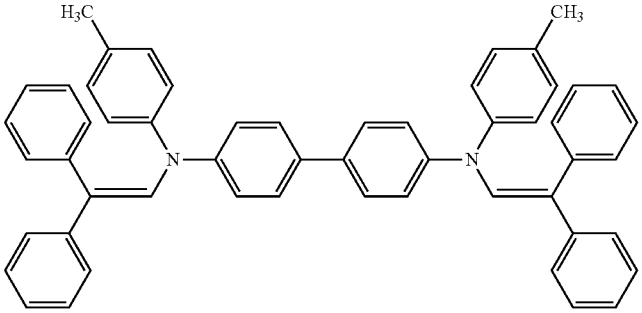 | −4.60 | 89.2 |
| 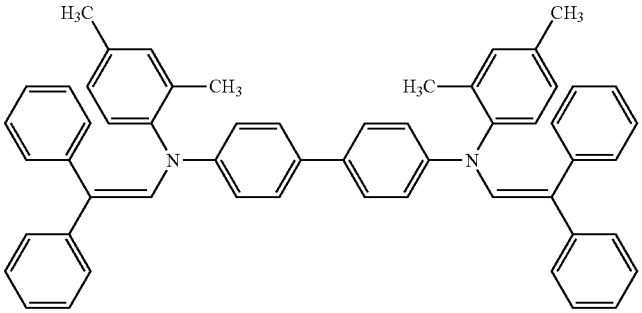 | −4.62 | 91.7 |
| 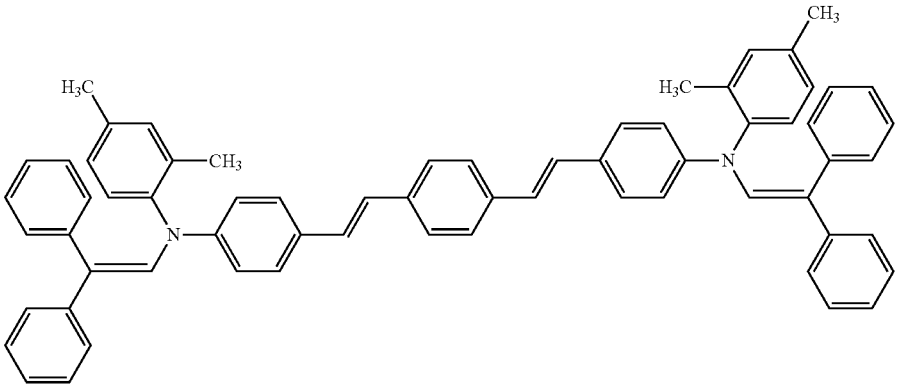 | −4.56 | 122.4 |

TABLE 2-continued
| Charge transport substance | E_homo (eV) | $\alpha_{cal}$ (Å$^3$) |
|---|---|---|
| 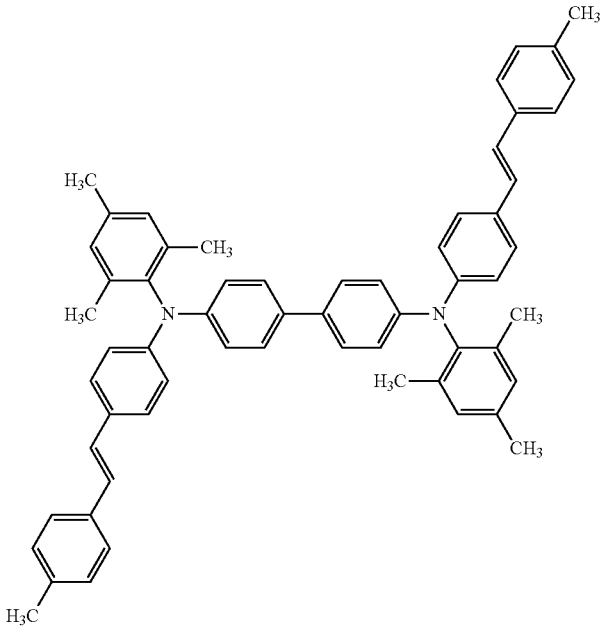 | −4.58 | 109.5 |
TABLE 3
| Charge transport substance | E_homo (eV) | $\alpha_{cal}$ (Å$^3$) |
|---|---|---|
| 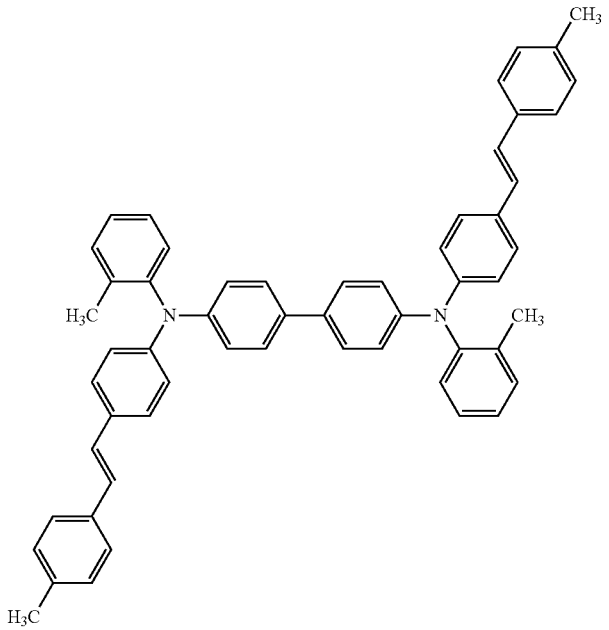 | −4.63 | 102.0 |

TABLE 3-continued
| Charge transport substance | E_homo (eV) | $\alpha_{cal}$ (Å$^3$) |
|---|---|---|
| 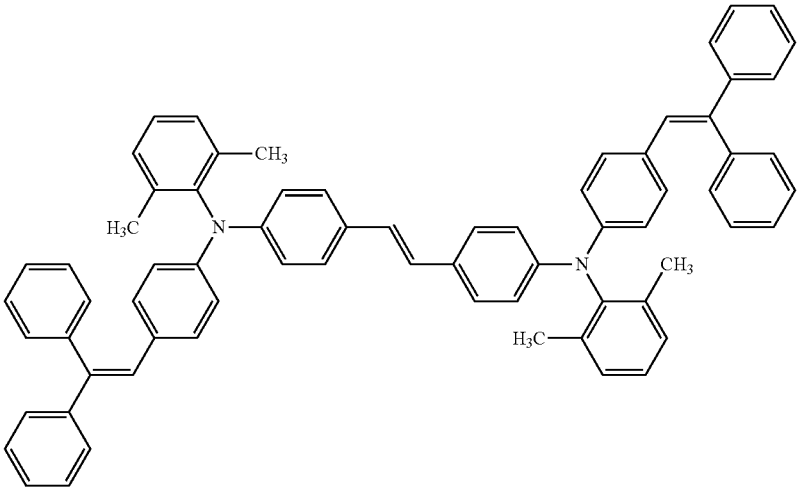 | −4.55 | 123.5 |
| 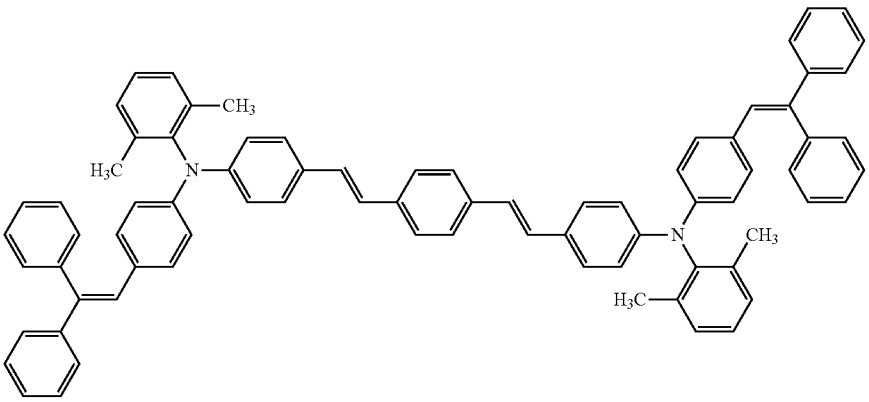 | −4.58 | 145.2 |
| 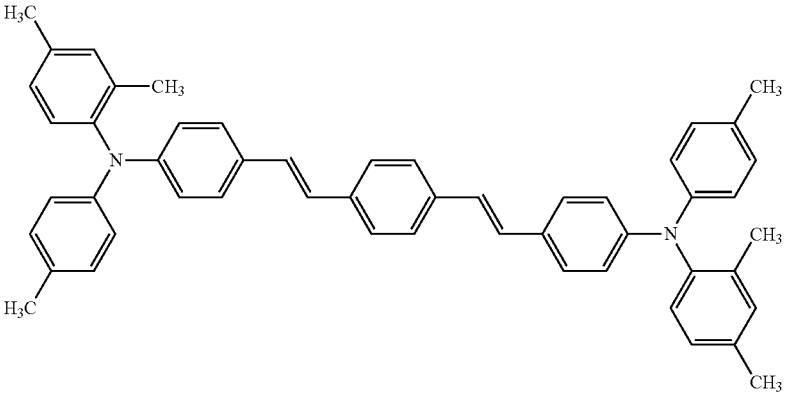 | −4.51 | 99.2 |

TABLE 3-continued
| Charge transport substance | E_homo (eV) | $\alpha_{cal}$ (Å$^3$) |
|---|---|---|
| 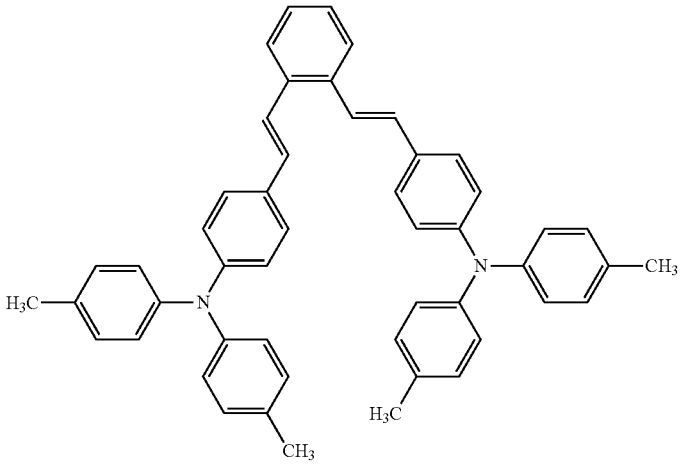 | −4.60 | 88.3 |
| 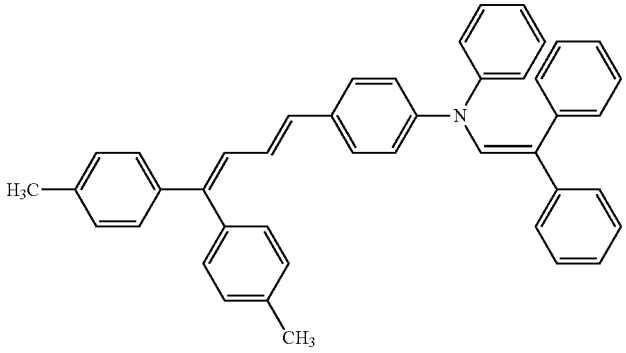 | −4.62 | 78.1 |
TABLE 4
| Charge transport substance | E_homo (eV) | $\alpha_{cal}$ (Å$^3$) |
|---|---|---|
| 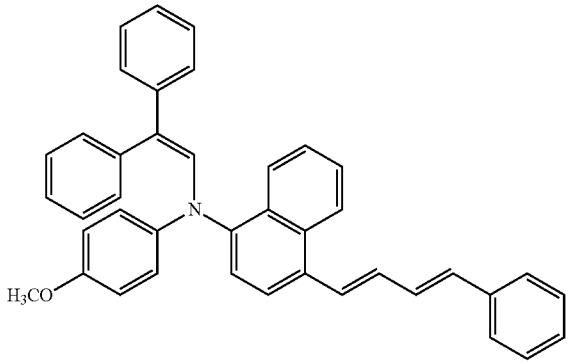 | −4.64 | 73.4 |

TABLE 4-continued
| Charge transport substance | E_homo (eV) | $\alpha_{cal}$ (Å$^3$) |
|---|---|---|
| 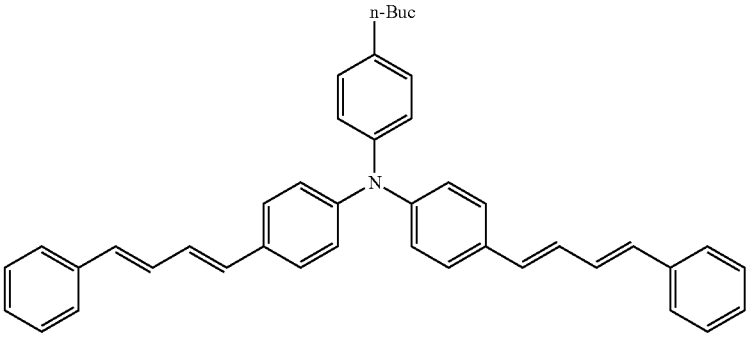 | −4.63 | 84.9 |
| 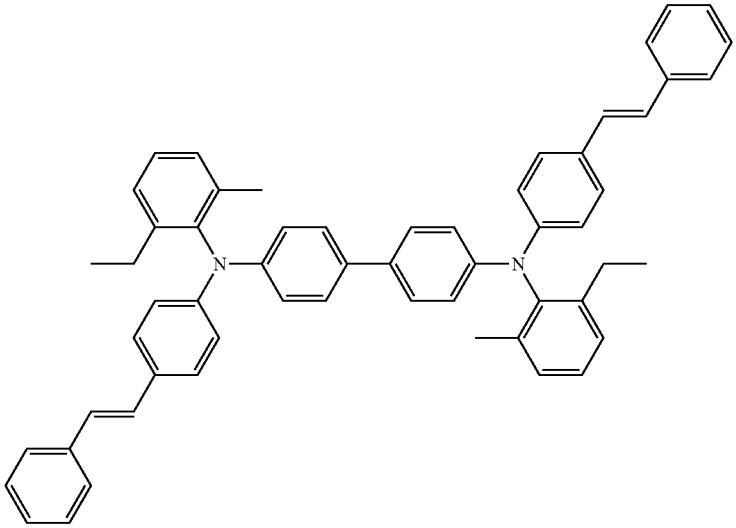 | −4.67 | 103.4 |
| 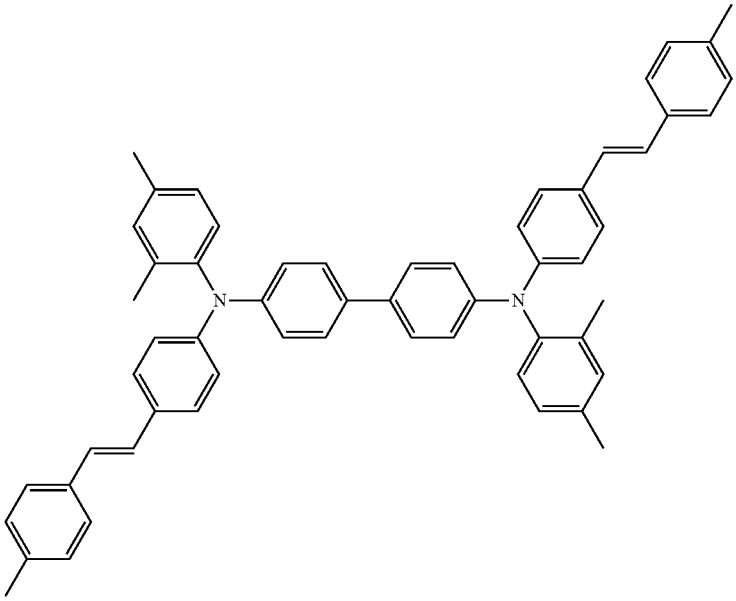 | −4.58 | 106.1 |

TABLE 4-continued

| Charge transport substance | E_homo (eV) | $\alpha_{cal}$ (Å$^3$) |
|---|---|---|
| 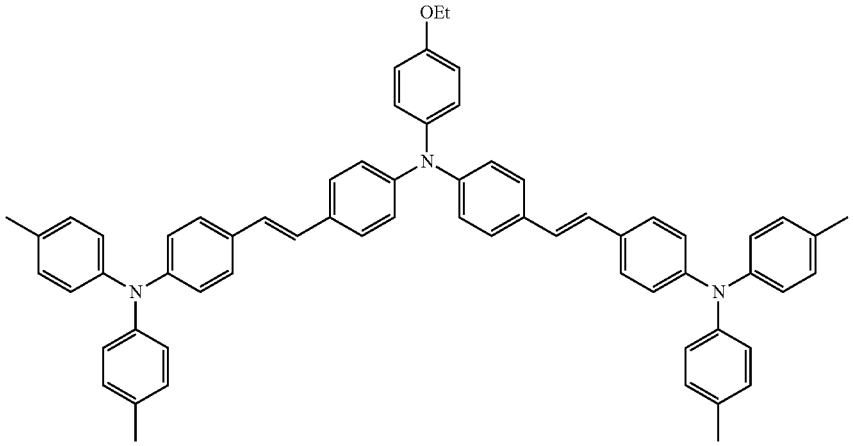 | −4.35 | 120.5 |

The ratio of the charge transport substance to the binder resin, the charge transport substance is typically equal to or greater than 10 parts by mass with respect to 100 parts by mass of the binder resin. In addition, the ratio is preferably equal to or greater than 20 parts by mass from the viewpoint of the reduction of the residual potential, and is further preferably equal to or greater than 30 parts by mass from the viewpoint of stability and charge mobility in repeated use. On the other hand, from the viewpoint of the thermal stability of the photosensitive layer, the ratio of the charge transport substance is equal to or less than 100 parts by mass to binder resin. Further, it is preferably equal to or less than 70 parts by mass from the viewpoint of compatibility between the charge transport substance and the binder resin, is further preferably equal to or less than 60 parts by mass from the viewpoint of the abrasion resistance, and is particularly preferably equal to or less than 50 parts by mass from the viewpoint of scratch resistance.

[Binder Resin]

The charge transport substance and the like are formed by being bonded by using a binder resin. Examples of the binder resin include a vinyl polymer such as polymethyl methacrylate, polystyrene, and polyvinyl chloride, and copolymers thereof, a thermoplastic resin such as polycarbonate, polyester, polyester polycarbonate, polysulfone, phenoxy, epoxy, and a silicone resin, and various thermosetting resins. Among these resins, from the viewpoint of light attenuation properties and the mechanical strength, the polycarbonate resin or the polyester resin is preferable as the photoreceptor.

Specific examples of a repeating structure unit suitable for the binder resin will be described below. These specific examples are merely for the sake of illustration, and any well-known binder resin may be mixed and used unless contrary to the gist of the present invention

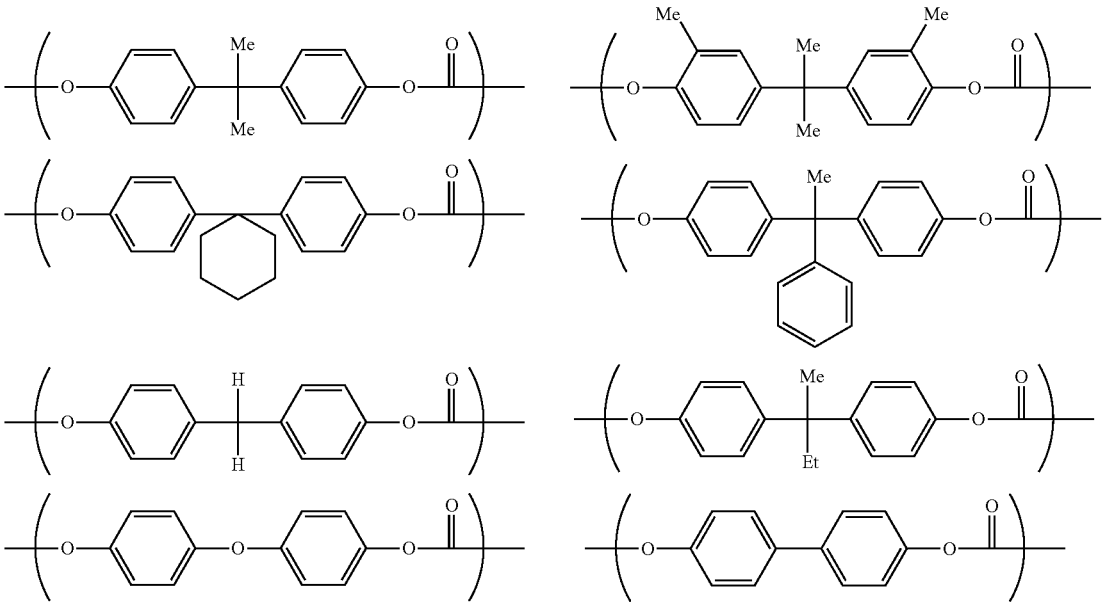

-continued

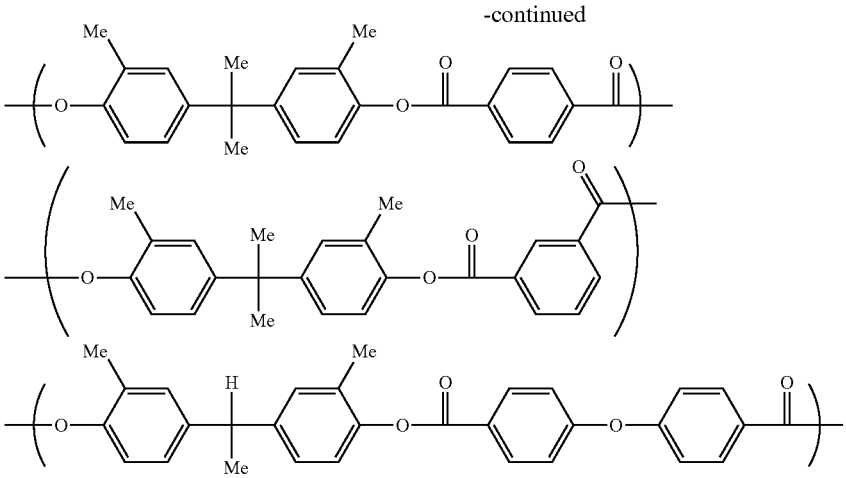

The viscosity average molecular weight of the binder resin is typically equal to or greater than 20,000, is preferably equal to or greater than 30,000, is further preferably equal to or greater than 40,000, and is still further preferably equal to or greater than 50,000 from the viewpoint of the mechanical strength, and is typically equal to or less than 150,000, is preferably equal to or less than 120,000, and is further preferably equal to or less than 100,000 form the viewpoint of the preparation of the coating fluid for forming a photosensitive layer.

[Other Additives]

For the purpose of improving film forming property, flexibility, coatability, contamination resistance, gas resistance or light fastness, additives such as a well-known antioxidant, a plasticizer, an ultraviolet absorber, an electron-withdrawing compound, a leveling agent, and a visible light shielding agent may be contained in the photosensitive layer or the respective layers to be formed. In addition, for the purpose of reducing the frictional resistance or wear of the surface of the photoreceptor or increasing the transfer efficiency of the toner from the photoreceptor to the transfer belt or paper, particles of a fluorine resin, a silicone resin, a polyethylene resin, or the like or particles of an inorganic compound may be contained in the charge transport layer.

<Method for Forming Each Layer>

The layers for constituting the photoreceptor are formed in the following manner. The substances to be incorporated into each layer are dissolved or dispersed in a solvent to obtain a coating fluid. The coating fluids thus obtained for the respective layers are successively applied on a conductive support by a known technique, such as dip coating, spray coating, nozzle coating, bar coating, roll coating, or blade coating, and dried. The constituent layers are formed by repeating this application and drying step for each layer.

The solvent or dispersion medium to be used for producing the coating fluids is not particularly limited. However, examples thereof include alcohols such as methanol, ethanol, propanol and 2-methoxyethanol, ethers such as tetrahydrofuran, 1,4-dioxane and dimethoxyethane, esters such as methyl formate and ethyl acetate, ketones such as acetone, methyl ethyl ketone, cyclohexanone, and 4-methoxy-4-methyl-2-pentanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichlorethylene, nitrogen-containing compounds such as n-butylamine, isopropanolamine, diethylamine, triethanolamine, ethylenediamine, and triethylenediamine, and aprotic polar solvents such as acetonitrile, N-methyl pyrrolidone, N,N-dimethyl formamide, and dimethyl sulfoxide. Further, these compounds may be used alone, or any desired two or more compounds of types may be used in combination.

The amount of the solvent or dispersion medium to be used is not particularly limited. It is, however, preferred to suitably regulate the amount thereof so that the properties of the coating fluid, such as solid concentration and viscosity, are within desired ranges, while taking account of the purpose of each layer and the nature of the selected solvent or dispersion medium.

In a preferred method for drying each coating fluid, the coating fluid applied is dried at room temperature until the coating film becomes dry to the touch, and is thereafter dried with heating at a temperature usually in the range of 30° C. to 200° C. for one minute to two hours, stationarily or with air blowing. The heating temperature may be constant, or the heating for drying may be conducted while changing the temperature.

<<Image Forming Apparatus>>

Next, embodiments of the image forming apparatus (image forming apparatus of the present invention) which employs the electrophotographic photoreceptor of the invention are explained by reference to FIG. 1, which illustrates the configuration of a main part of the apparatus. Note that, the embodiments of the apparatus are not limited to the following descriptions and the apparatus can be modified at will unless the modifications depart from the spirit of the invention.

As illustrated in FIG. 1, the image forming apparatus is provided with an electrophotographic photoreceptor 1, a charging device 2, an exposure device 3, and a developing device 4, and if necessary, is further provided with a transfer device 5, a cleaning device 6, and a fixing device 7.

The electrophotographic photoreceptor 1 is not particularly limited as long as it is the electrophotographic photoreceptor of the invention described above. FIG. 1 illustrates, as an example thereof, a drum-shaped photoreceptor obtained by forming the photosensitive layer described above on the surface of a cylindrical conductive support. The charging device 2, the exposure device 3, the developing device 4, the transfer device 5, and the cleaning device 6 are disposed along the peripheral surface of this electrophotographic photoreceptor 1.

The charging device 2 is for charging the electrophotographic photoreceptor 1, and evenly charges the surface of the electrophotographic photoreceptor 1 to a given potential. Examples of the typical charging device include a non-contact corona charging device such as such as a corotron or a scorotron, and a contact type charging device (direct charging device) in which a direct charging member to which a voltage is being applied comes in contact with the photoreceptor surface to charge the surface, or the like. Examples of the contact type charging device include a charging roller and a charging brush.

Note that, FIG. 1 illustrates a roller type charging device (charging roller) as an example of the charging device 2. Typically, the charging roller is manufactured by integrally molding additives such as a resin and a plasticizer with a metal shaft, and may have a laminated structure as necessary. As a voltage to be applied at the time of charging, it is possible to use only a direct current voltage, or to superimpose an alternating current on the direct current.

The exposure device 3 conducts exposure on the electrophotographic photoreceptor 1, and is not particularly limited to the types thereof as long as an electrostatic latent image can be formed on the photosensitive surface of the electrophotographic photoreceptor 1. Specific examples thereof include halogen lamps, fluorescent lamps, lasers such as semiconductor lasers and He—Ne lasers, and LEDs. It is also possible to conduct exposure by the technique of internal photoreceptor exposure. Any desired light may be used for exposure. For example, monochromatic light having a wavelength of 780 nm, monochromatic light having a slightly short wavelength in a range of 600 nm to 700 nm, monochromatic light having a short wavelength in a range of 380 nm to 500 nm, or the like may be used to conduct exposure.

The type of the toner T is not limited, and a polymerization toner or the like obtained by suspension polymerization, emulsion polymerization, and the like can be used besides a powdery toner. Particularly when a polymerization toner is used, this toner preferably is one having a small particle diameter in a range of 4 to 8 μm. The toner particles to be used can have any of various shapes ranging from a shape close to sphere to a shape which is not spherical, such as a potato shape. Polymerization toners are excellent in terms of evenness of charging and transferability and are suitable for image quality improvement.

The transfer device 5 is not particularly limited to the type thereof, and use can be made of a device operated by any desired method selected from an electrostatic transfer method, a pressure transfer method, an adhesive transfer method, and the like, such as, corona transfer, roller transfer, and belt transfer. Here, the transfer device 5 is a device configured of a transfer charger, a transfer roller, a transfer belt, or the like disposed so as to face the electrophotographic photoreceptor 1. A given voltage value (transfer voltage) which has the polarity opposite to that of the charge potential of the toner T is applied to the transfer device 5, and this transfer device 5 thus serves to transfer the toner image formed on the electrophotographic photoreceptor 1 to recording paper (paper or medium) P.

There are no particular limitations on the cleaning device 6, and any desired cleaning device can be used, such as a brush cleaning device, a magnetic brush cleaning device, an electrostatic brush cleaning device, a magnetic roller cleaning device, or a bladed cleaning device. The cleaning device 6 serves to scrape off the residual toner adherent to the photoreceptor 1 with a cleaning member and thus recovers the residual toner. However, when there is little or substantially no toner adherent to the surface of the photoreceptor, the cleaning device 6 may be omitted.

The fixing device 7 is provided with an upper fixing member (fixing roller) 71 and a lower fixing member (fixing roller) 72. The fixing member 71 or 72 is equipped with a heater 73 inside. FIG. 1 illustrates an example in which the upper fixing member 71 is equipped with a heater 73 inside. As each of the upper and lower fixing members 71 and 72, it is possible to use a known heat-fixing member such as a fixing roll obtained by coating a metallic tube made of stainless steel, aluminum, or the like with a silicone rubber, a fixing roll obtained by coating the metallic tube with a Teflon (trademark) resin, or a fixing sheet. Further, the fixing members 71 and 72 may be configured so that a release agent such as a silicone oil is supplied thereto in order to improve release properties, or may be configured so that the two members are forcedly pressed against each other with springs or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P. The fixing device also is not particularly limited the types thereof. Fixing devices which are operated by any desired fixing technique, such as heated-roller fixing, flash fixing, oven fixing, or pressure fixing, can be disposed besides the fixing device used here.

In the electrophotographic apparatus having the configuration described above, image recording is conducted in the following manner. In other words, first, the surface (photosensitive surface) of the photoreceptor 1 is charged to a given potential (for example, −600 V) by the charging device 2. In this case, this charging may be conducted with a direct-current voltage or with a direct-current voltage on which an alternating-current voltage has been superimposed.

Subsequently, the charged photosensitive surface of the photoreceptor 1 is exposed to light by the exposure device 3 in accordance with the image to be recorded. Thus, an electrostatic latent image is formed on the photosensitive surface. This electrostatic latent image formed on the photosensitive surface of the photoreceptor 1 is developed by the developing device 4.

In the developing device 4, toner T fed by the feed roller 43 is spread into a thin layer with the control member (developing blade) 45 and, simultaneously therewith, frictionally charged so as to have given polarity. This toner T is transported while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This toner image is transferred to the recording paper P by the transfer device 5. Thereafter, the toner which has not been transferred and remains on the photosensitive surface of the photoreceptor 1 is removed by the cleaning device 6.

After the transfer of the toner image to the recording paper P, this recording paper P is passed through the fixing device 7 to thermally fix the toner image to the recording paper P. Thus, a finished image is obtained.

Incidentally, the image forming apparatus may be configured so that an erase step, for example, can be conducted, besides the configuration described above. The erase step is a step in which the electrophotographic photoreceptor is exposure to light to thereby remove the residual charges from the electrophotographic photoreceptor. As an eraser, use may be made of a fluorescent lamp, LED, or the like. The light to be used in the erase step, in many cases, is light having such an intensity that the exposure energy thereof is at least 3 times that of the exposure light. From the standpoint of miniaturization and energy saving, it is preferable not to have the erase step.

In addition, the configuration of the image forming apparatus may be further modified. For example, the apparatus may be configured so that steps such as a pre-exposure step and an auxiliary charging step can be conducted therein, or may be configured so that offset printing is conducted therein. Furthermore, the apparatus may have a full-color tandem configuration in which a plurality of toners are used.

Incidentally, the electrophotographic photoreceptor 1 may be combined with one or more of the charging device 2, exposure device 3, developing device 4, transfer device 5, cleaning device 6, and fixing device 7 to constitute an integrated cartridge (hereinafter suitably referred to as "electrophotographic photoreceptor cartridge"), and this electrophotographic photoreceptor cartridge may be used in a configuration in which the cartridge can be demounted from the main body of an electrophotographic apparatus, or the like, copier or laser beam printer.

EXAMPLES

Hereinafter, the embodiments of the present invention will be described in detail with reference to Examples. Note that, the following examples are merely for describing the present invention in detail, and the invention should not be construed as being limited to the following Examples and can be modified at will unless the modifications depart from the spirit of the invention. In the following Examples and Comparative Examples, the term "parts" means "parts by mass" unless otherwise indicated.

<Preparation of Compound>

Preparing Example 1: Example Compound AD-1

Example Compound AD-1 was prepared in accordance with the following scheme 1.

Scheme 1

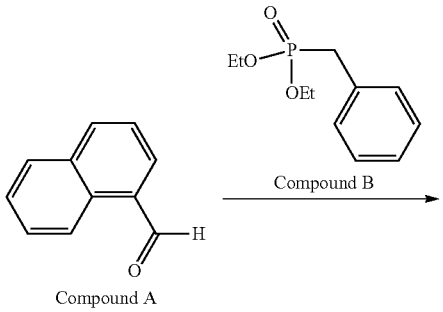

-continued

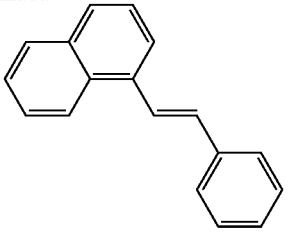

AD-1

An aldehyde compound A (8.0 g) and a phosphate ester compound B (17.5 g) were put into 60 ml of THF (tetrahydrofuran) and cooled down to 5° C. A t-butoxy potassium compound (8.6 g) was dissolved in another 40 ml of THF, the solution was added dropwise to the cooled solution, and after completion of the dropwise addition, the mixture was reacted at room temperature for one hour. After completion of the reaction, the reaction solution was discharged into water and after extraction with toluene, the organic layer was concentrated, and the concentrated residue was purified by silica gel chromatography, thereby obtaining 10.3 g of desired additive AD-1 (yield, 87%).

Preparing Example 2: Example Compound AD-5

Example Compound AD-5 was prepared in accordance with the following scheme 2.

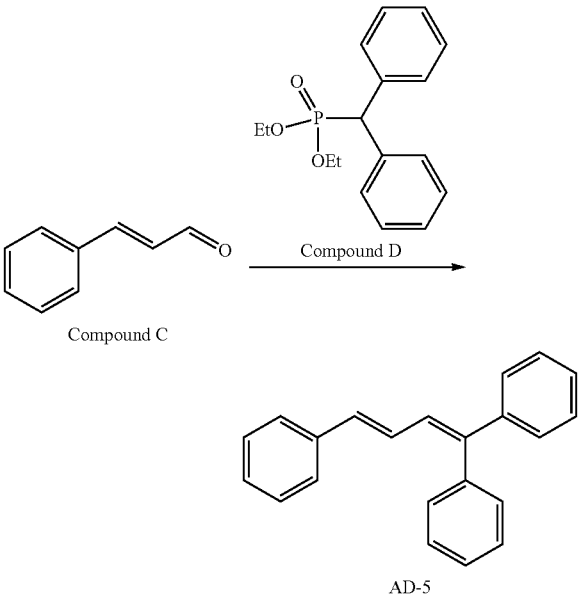

An aldehyde compound C (60 g) and a phosphate ester compound D (138 g) were put into 500 ml of THF, and cooled down to 5° C. A t-butoxy potassium compound (56 g) was dissolved in another 200 ml of THF, the solution was added dropwise to the cooled solution, and after completion of the dropwise addition, the mixture was reacted at room temperature for one hour. After completion of the reaction, the reaction solution was discharged into water and after extraction with toluene, the organic layer was concentrated, and the concentrated residue was purified by silica gel chromatography, thereby obtaining 85 g of desired additive AD-5 (yield, 66%).

Preparing Examples 3 to 10

AD-2 to AD-4 and AD-6 to AD-10 indicated in the above-described Table 1 were prepared by using the same method as that used in Preparing Example 1.

<Preparation of Additive-Containing Polycarbonate Resin Film>

Measurement Example 1

100 parts of polycarbonate resin (PC-1) (UPIZETA PCZ-400 prepared by Mitsubishi Gas Chemical Company, Inc: viscosity average molecular weight of 40,000) having a repeating structure represented by the following formula (1), 10 parts of AD-1 prepared by the above-described Preparing Example 1, and 0.05 parts of silicone oil as a leveling agent were dissolved in 440 parts of a tetrahydrofuran/toluene (8/2 by mass) mixed solvent.

A glass substrate was coated with the obtained solution by using an applicator such that the film thickness becomes 25 μm after drying, the coated film was dried at 125° C. for 20 minutes, and thereby an AD-1-containing polycarbonate resin film was prepared. The measurement results of the universal hardness and the elastic deformation rate are indicated in Table 5.

Formula (1)

PC-1

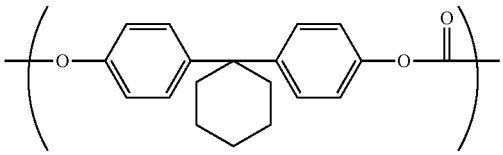

<Measurement of Universal Hardness and Elastic Deformation Rate>

For the measurement of universal hardness and elastic deformation rate, the coated film on the glass substrate was measured under the environment of the temperature of 25° C. and the relative humidity of 50% by using a microhardness meter (FISCHERSCOPE HM2000 manufactured by Fischer) with the following measurement conditions.

(Universal Hardness and Elastic Deformation Rate Measurement Condition)

Indenter: Vickers square pyramid diamond indenter having facing angle of 136°

Maximum indentation load: 5 mN

Load-increasing period: 10 seconds

Load-removing period: 10 seconds

Figure 4:
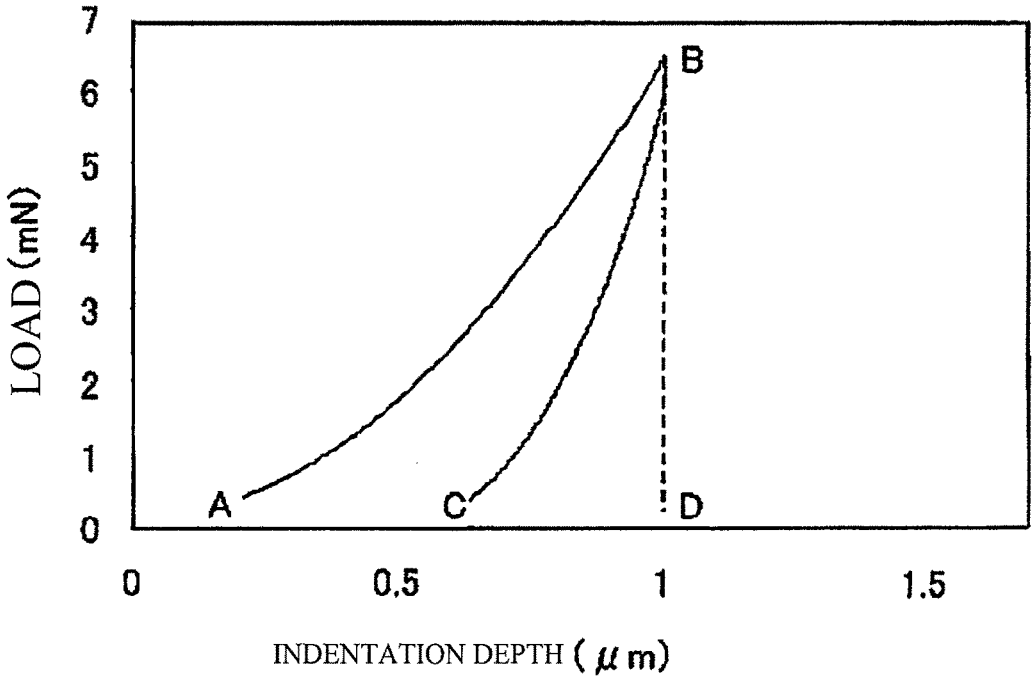
FIG. 4 is a graph illustrating a load curve against an indentation depth of a resin film and a photoreceptor, and is a schematic view illustrating a method of calculating universal hardness and an elastic deformation rate.

The measurement was conducted under the above-described conditions, and the load being imposed on the indenter and the indentation depth under the load were continuously read and plotted as Y-axis and X-axis, respectively, thereby acquiring a profile such as that illustrated in FIG. 4. The universal hardness is obtained by the following Equation (a). The larger the universal hardness, the less dents due to loading.

$$\text{Universal hardness (N/mm}^2\text{)} = \text{maximum indentation load/dent area maximum at the time of indentation load} \quad \text{Equation (a)}$$

The elastic deformation rate is the value defined by the following Equation (b), and is the proportion of the amount of the work which the film performs by means of the elasticity thereof during the load removal to the total amount of the work required for the indentation. The higher the elastic deformation rate, the less the deformation caused by load remains. The case where the elastic deformation rate is 100 means that no deformation remains.

$$\text{Elastic deformation rate (\%)} = (We/Wt) \times 100 \quad \text{Equation (b)}$$

In the equation, the total amount of work, Wt (nJ), indicates the area surrounded by A-B-D-A in FIG. 4, and the amount of the work made by the elastic deformation, We (nJ), indicates the area surrounded by C-B-D-C.

Measurement Examples 2 to 8

The measurements of the universal hardness and the elastic deformation rate were performed by forming a film in the same manner as that used in Measurement example 1 except that AD-1 was changed to the additive indicated in the following Table 5.

Measurement Example 9

The measurements of the universal hardness and the elastic deformation rate were performed by forming a film in the same manner as that used in Measurement example 1 except that AD-1 was not added.

Measurement Examples 10 to 14

The measurements of the universal hardness and the elastic deformation rate were performed by forming a film in the same manner as that used in Measurement example 1 except that AD-1 was changed to the additive indicated in the following Table 5. Note that, the structures of the additives used in Measurement examples 10 to 14, energy levels of HOMO E_homo obtained by the result of the structural optimization calculation based on the density functional calculation at the B3LYP/6-31G (d,p), and dipole moment $\mu_{calc}$ and polarizability $\alpha_{calc}$ which are obtained by the result of the HF/6-31G (d,p) calculation after the structural optimization calculation are indicated in the following Table 6.

TABLE 5

| | Additive | Universal hardness (N/mm$^2$) | Elastic deformation rate (%) |
|---|---|---|---|
| Measurement example 1 | AD-1 | 162.6 | 41.5 |
| Measurement example 2 | AD-2 | 163.7 | 42.1 |
| Measurement example 3 | AD-3 | 182.2 | 43.0 |
| Measurement example 4 | AD-4 | 167.3 | 41.6 |
| Measurement example 5 | AD-5 | 168.1 | 41.7 |
| Measurement example 6 | AD-6 | 162.4 | 41.5 |
| Measurement example 7 | AD-7 | 157.9 | 41.9 |
| Measurement example 8 | AD-8 | 167.9 | 41.4 |
| Measurement example 9 | — | 130.0 | 40.9 |
| Measurement example 10 | AD-11 | 151.0 | 41.2 |
| Measurement example 11 | AD-12 | 154.4 | 39.7 |
| Measurement example 12 | AD-13 | 152.6 | 41.2 |
| Measurement example 13 | AD-14 | 143.9 | 42.6 |
| Measurement example 14 | AD-15 | 161.1 | 41.0 |

TABLE 6

| | Structure | Molecular weight | E_homo (eV) | $\mu_{calc}$ (debye) | $\alpha_{calc}$ (Å$^3$) |
|---|---|---|---|---|---|
| AD-11 | 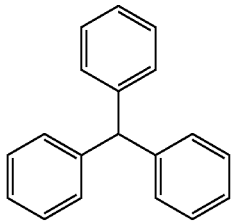 | 244.34 | −6.21 | 0.0165 | 26.522 |
| AD-12 | 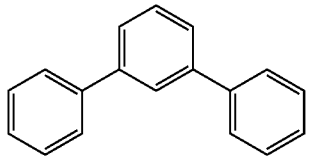 | 230.3 | −5.83 | 0.0037 | 26.930 |
| AD-13 | 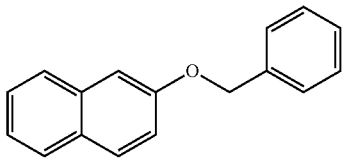 | 234.3 | −5.46 | 0.5605 | 25.649 |
| AD-14 | 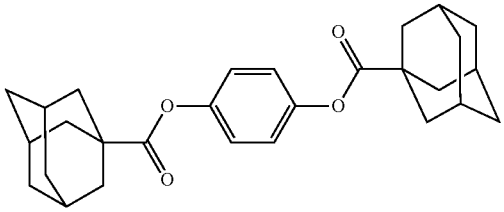 | 434.58 | −6.28 | 0.0001 | 40.385 |
| AD-15 | 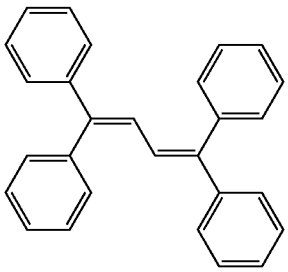 | 358.48 | −5.13 | 0.0002 | 45.773 |
| AD-16 | 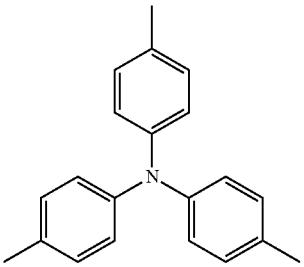 | 287.41 | −4.72 | 0.016 | 33.010 |

<Production of Electrophotographic Photosensitive Sheet>

Example 1

The dispersion for an undercoat layer was prepared by using the following method. That is, a surface-treated titanium oxide obtained by putting a rutile titanium oxide having an average primary-particle diameter of 40 nm ("TTO55N", manufactured by Ishihara Sangyo Co., Ltd.) with 3% by mass of methyldimethoxysilane ("TSL8117", manufactured by Toshiba Silicone Co., Ltd.) into a high-speed fluid type mixing and kneading machine ["SMG300" manufactured by KAWATA MFG Co., Ltd.], and mixing at high rotational speed of 34.5 m/sec was dispersed by using Ball mill of methanol/1-propanol so as to obtain a dispersion slurry of hydrophobized titanium oxide. The dispersion slurry and a methanol/1-propanol/toluene mixed solvent were stirred and mixed, with heating, together with pellets of a copolyamide having a composition in which the ε-caprolactam [compound represented by the following Formula (F)]/bis(4-amino-3-methylcyclohexyl)methane [compound represented by the following Formula (G)]/hexamethylenediamine [compound represented by the following formula (H)]/decamethylenedicarboxylic acid [compound represented by the following formula (I)]/octadecamethylenedicarboxylic acid [compound represented by the following formula (J)] molar ratio was 60%/15%/5%/15%/5%. After the polyamide pellets were dissolved, this mixture was subjected to an ultrasonic dispersion treatment. Thus, a coating fluid for forming an undercoat layer which had a methanol/1-propanol/toluene ratio of 7/1/2 by mass, contained the hydrophobically treated titanium oxide and the copolyamide in a mass ratio of 3/1, and had a solid concentration of 18.0% was obtained.

F

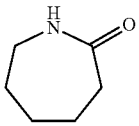

G

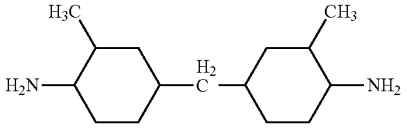

H

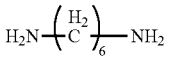

-continued

I

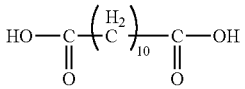

J

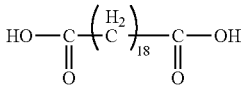

Figure 2:
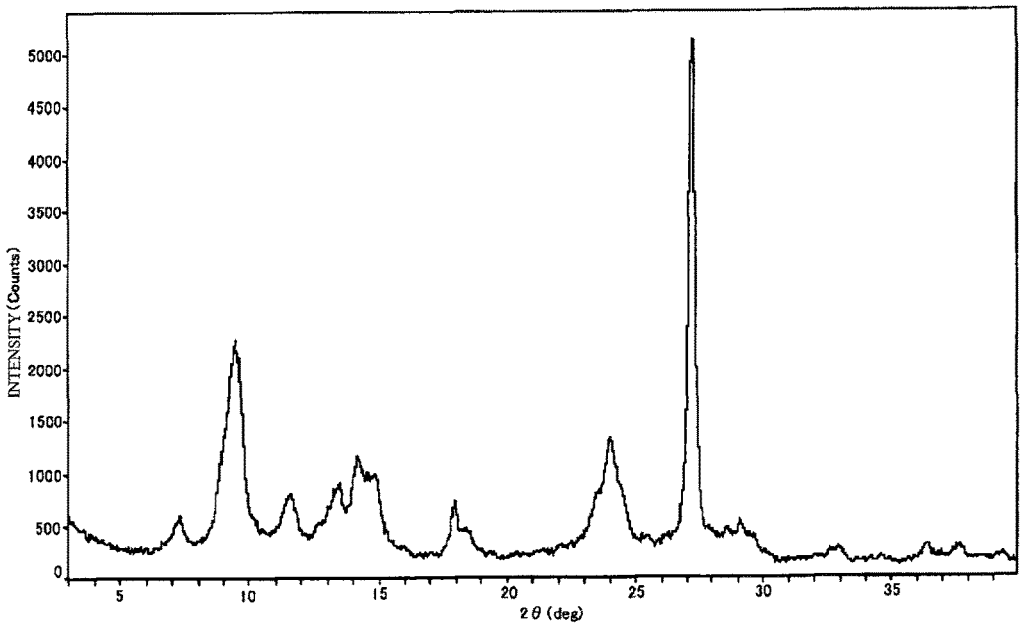
FIG. 2 is a diagram illustrating an X-ray diffraction spectrum by CuKα characteristic radiation of oxytitanium phthalocyanine used in Examples.

The coating fluid for a charge generation layer was prepared by using the following method. 10 parts of oxytitanium phthalocyanine showing intense diffraction peak at a Bragg angle (2θ±0.2) of 27.3° in the X-ray diffraction spectrum obtained with CuKα characteristic X-ray, and having an X-ray powder diffraction spectrum as illustrated in FIG. 2 was added to 150 parts of 1,2-dimethoxyethane, and was subjected to a pulverization and dispersing treatment with a sand grinding mill so as to prepare a pigment dispersion. 160 parts by mass of pigment dispersion obtained as described method, 100 parts by mass of 5% 1,2-dimethoxyethane solution of polyvinyl butyral [trade name #6000C, manufactured by Denki Kagaku Kogyo K.K.], and an appropriate amount of 1,2-dimethoxyethane were mixed with each other, thereby resulting in preparing a dispersion having the solid concentration of 4.0%.

The coating fluid for a charge transport layer was prepared by using the following method. 40 parts by mass of charge transport material (HTM34) prepared by using the method described in Preparing Example 1 disclosed in JP-A-2014-81621, 100 parts by mass of polyester resin (PE-1: viscosity average molecular weight of 36,500), 10 parts by mass of additive AD-1, 4 parts by mass of antioxidant (IRGANOX 1076), and 0.05 parts by mass of silicone oil as a leveling agent were mixed with 640 parts by mass of mixed solvent of tetrahydrofuran and toluene (80% by mass of tetrahydrofuran and 20% by mass of toluene) so as to prepare a coating fluid for forming a charge transport.

HTM34

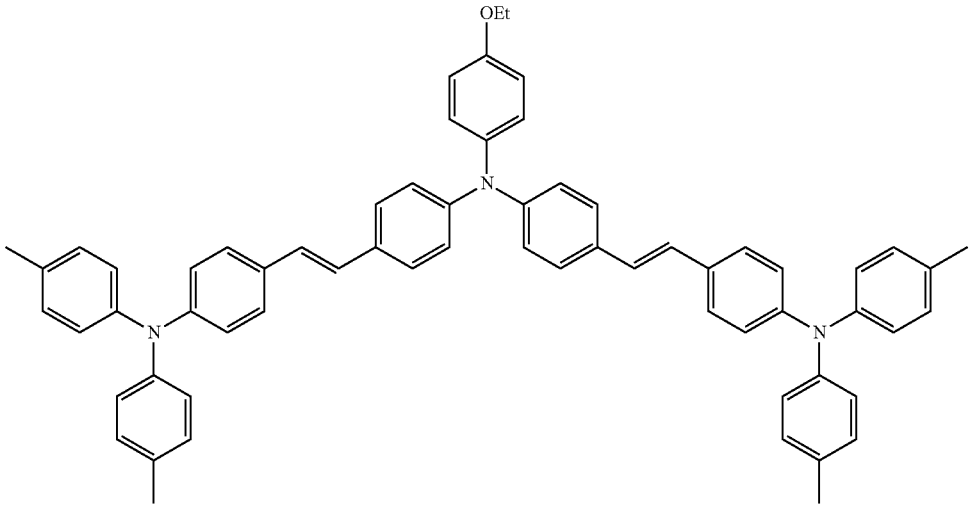

PE-1

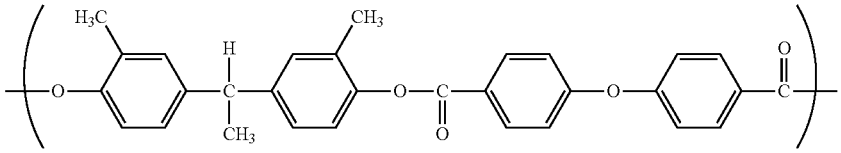

A polyethylene terephthalate sheet in which aluminum is deposited on a surface was coated with the dispersion for an undercoat layer by using a bar coater such that the film thickness after drying became 1.25 μm, and then dried so as to form an undercoat layer. Subsequently, the undercoat layer was coated with the coating fluid for a charge generation layer by using a wire bar such that the film thickness after drying became 0.4 μm, and then dried so as to form a charge generation layer. Then, the charge generation layer was coated with the coating fluid for charge transport by using an applicator such that the film thickness after drying became 18 μm, and then dried at 125° C. for 20 minutes so as to form a charge transport layer, thereby producing a photosensitive sheet.

Examples 2 to 10

The photosensitive sheet was produced by using the same method used in Example 1 except that AD-1 was charged to the additives indicated in Table 7.

Example 11

The photosensitive sheet was produced by using the same method used in Example 1 except that AD-1 (10 parts by mass) was changed to AD-5 (5 parts by mass).

Comparative Example 1

The photosensitive sheet was produced by using the same method used in Example 1 except that AD-1 was not added.

Comparative Examples 2 to 6

The photosensitive sheet was produced by using the same method used in Example 1 except that AD-1 was changed to the additives illustrated in the Table 7.

Comparative Example 7

The photosensitive sheet was produced by using the same method used in Example 1 except that AD-1 (10 parts by mass) was changed to AD-13 (5 parts by mass).

<Measurement of Universal Hardness and Elastic Deformation Rate of Charge Transport Layer>

Samples for the measurement of the universal hardness and the elastic deformation rate of the charge transport layer was prepared by coating the glass substrate with the coating fluid for a charge transport layer prepared in Examples 17 to 27 and Comparative Examples 13 to 19 by using an applicator such that the film thickness became 25 μm after drying, and drying the coating film at 125° C. for 20 minutes. The obtained coated film on the glass substrate was measured under the environment of the temperature of 25° C. and the relative humidity of 50% by using a microhardness meter (FISCHERSCOPE HM2000 manufactured by Fischer) with the following measurement conditions. The results are indicated in Table 7.

<Evaluation of Electrical Properties>

The electrophotographic photosensitive sheets in Examples 1 to 11 and Comparative Examples 1 to 7 were each mounted on an apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Ōyō*, Corona Publishing Co., Ltd., pp. 404-405, 1996), and cycling which included charging, exposure, potential measurement, and erase was performed in the following manner to thereby evaluate the electrical properties.

Under the conditions of a temperature of 25° C. and a humidity of 50%, the photoreceptor was charged so as to result in an initial surface potential of −700 V and then exposed, at an irradiation energy of 0.9 μJ/cm$^2$, to monochromatic light of 780 nm obtained from the light of a halogen lamp by means of an interference filter. Thereafter, the surface potential (unit: −V) was measured and taken as residual potential. The results are indicated in Table 7. When the residual potential is low, the properties of the photoreceptor become more excellent.

<Evaluation of Charge Retention Rate after Ozone Exposure>

A method for an ozone exposure test will be described as follows. The electrophotographic photosensitive sheets of Examples 1 to 11 and Comparative Examples 1 to 7 were charged by applying 25 μA of current to a corotron charger with EPA-8200 manufactured by Kawaguchi Electric Works, and the obtained charged value was set to V1. Thereafter, the photoreceptors were exposed to ozone having a concentration of 300 to 400 ppm for three to five hours a day for two days, the charged value was similarly measured after exposure, and this value was set as V2. The charge retention rate (V2/V1×100) (%) before and after the ozone exposure is indicated in Table 7. The higher the charge retention rate, the harder it is to deteriorate.

TABLE 7

| | Additive | Number of parts | Universal hardness of charge transport layer (N/mm$^2$) | Elastic deformation rate of charge transport layer (%) | Residual potential (−V) | Charge retention rate after ozone exposure (%) |
|---|---|---|---|---|---|---|
| Example 1 | AD-1 | 10 | 159.9 | 41.3 | 24 | 76 |
| Example 2 | AD-2 | | 160.1 | 41.7 | 23 | 77 |
| Example 3 | AD-3 | | 165.3 | 42.5 | 23 | 81 |
| Example 4 | AD-4 | | 159.6 | 41.8 | 23 | 79 |
| Example 5 | AD-5 | | 162.3 | 41.8 | 23 | 81 |
| Example 6 | AD-6 | | 162.4 | 41.7 | 23 | 79 |
| Example 7 | AD-7 | | 160.8 | 41.1 | 21 | 77 |
| Example 8 | AD-8 | | 164.5 | 41.2 | 22 | 79 |
| Example 9 | AD-9 | | 162.6 | 43 | 24 | 78 |
| Example 10 | AD-10 | | 165.8 | 42.2 | 24 | 80 |
| Example 11 | AD-5 | 5 | 151 | 41.8 | 22 | 74 |
| Comparative Example 1 | — | | 132.6 | 41 | 23 | 60 |

TABLE 7-continued

| | Additive | Number of parts | Universal hardness of charge transport layer ($N/mm^2$) | Elastic deformation rate of charge transport layer (%) | Residual potential (−V) | Charge retention rate after ozone exposure (%) |
|---|---|---|---|---|---|---|
| Comparative Example 2 | AD-11 | 10 | 150.9 | 40.7 | 23 | 68 |
| Comparative Example 3 | AD-12 | | 153.8 | 39.6 | 22 | 71 |
| Comparative Example 4 | AD-13 | | 152 | 39.9 | 24 | 69 |
| Comparative Example 5 | AD-14 | | 141.7 | 41.7 | 26 | 61 |
| Comparative Example 6 | AD-15 | | 150.4 | 41 | 23 | 68 |
| Comparative Example 7 | AD-16 | | 151.2 | 41 | 23 | 66 |
| Comparative Example 8 | AD-13 | 5 | 147.3 | 40.8 | 23 | 70 |

Example 12

The photosensitive sheet was produced by using the same method used in Example 1 except that additive AD-1 was changed to AD-5, and the binder resin PE-1 was changed to a polyester resin (PE-2: viscosity average molecular weight of 40,000).

(PE-2)

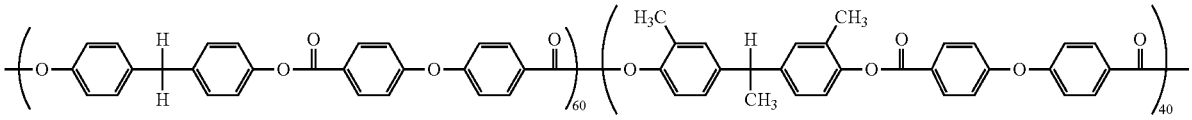

Comparative Example 9

The photosensitive sheet was produced by using the same method used in Example 12 except that AD-5 was not added.

Comparative Example 10

The photosensitive sheet was produced by using the same method used in Example 12 except that AD-5 was changed to AD-13.

Example 13

The photosensitive sheet was produced by using the same method used in Example 12 except that the binder resin PE-2 was charged to PC-1.

Comparative Example 11

The photosensitive sheet was produced by using the same method used in Example 13 except that AD-5 was not added.

Example 14

The photosensitive sheet was produced by using the same method used in Example 12 except that the binder resin PE-2 was charged to a polycarbonate resin (PC-2: viscosity average molecular weight of 50,000).

(PC-2)

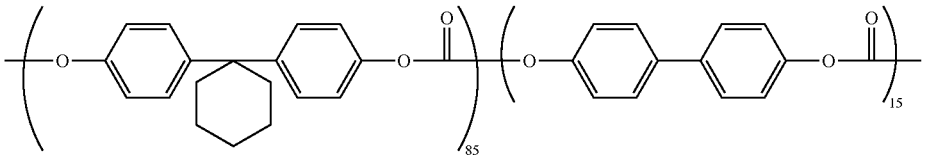

Comparative Example 12

The photosensitive sheet was produced by using the same method used in Example 14 except that AD-5 was not added.

Example 15

The photosensitive sheet was produced by using the same method used in Example 12 except that the binder resin PE-2 was charged to a polycarbonate resin (PC-3: viscosity average molecular weight of 30,000).

(PC-3)

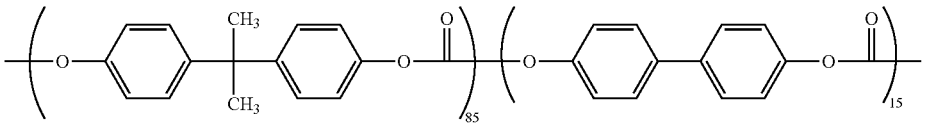

Comparative Example 13

The photosensitive sheet was produced by using the same method used in Example 15 except that AD-5 was not added.

Regarding the electrophotographic photosensitive sheets of Examples 12 to 15 and Comparative Examples 9 to 13, the measurement of the universal hardness and the elastic deformation rate of the charge transport layer, the evaluation of the electrical properties and the evaluation of the charge retention rate after ozone exposure were performed by using the same method as described above. The results are indicated in the following Table 8.

TABLE 8

| | Binder resin | Additive (Number of parts) | Universal hardness of charge transport layer ($N/mm^2$) | Elastic deformation rate of charge transport layer (%) | Residual potential (−V) | Charge retention rate after ozone exposure (%) |
|---|---|---|---|---|---|---|
| Example 12 | PE-2 | AD-5 (10) | 150.9 | 40.7 | 20 | 80 |
| Comparative Example 9 | | — | 124.9 | 40.6 | 20 | 50 |
| Comparative Example 10 | | AD-13 (10) | 139.8 | 39.2 | 21 | 73 |
| Example 13 | PC-1 | AD-5 (10) | 177 | 38.5 | 11 | 87 |
| Comparative Example 11 | | — | 143.4 | 38.8 | 19 | 84 |
| Example 14 | PC-2 | AD-5 (10) | 172.2 | 39.4 | 12 | 86 |
| Comparative Example 12 | | — | 139 | 39.3 | 22 | 79 |
| Example 15 | PC-3 | AD-5 (10) | 158 | 35.9 | 14 | 61 |
| Comparative Example 13 | | — | 130.8 | 34.1 | 16 | 19 |

Example 16

The photosensitive sheet was produced by using the same method used in Example 1 except that additive AD-1 (10 parts) was changed to AD-8 (5 parts), and the charge transport material HTM1 is charged to the following HTM2.

HTM2

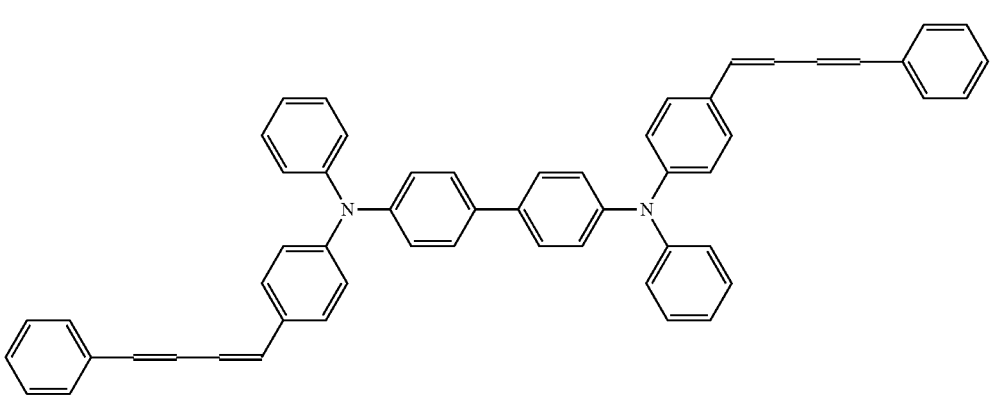

Comparative Example 14

The photosensitive sheet was produced by using the same method used in Example 16 except that AD-8 was not added.

Example 17

The photosensitive sheet was produced by using the same method used in Example 16 except that the charge transport material HTM2 was changed to the following HTM3.

HTM3

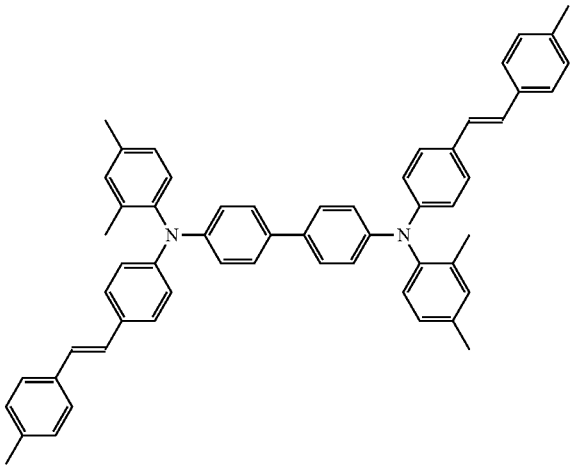

Comparative Example 15

The photosensitive sheet was produced by using the same method used in Example 17 except that AD-8 was not added.

Example 18

The photosensitive sheet was produced by using the same method used in Example 16 except that the charge transport material HTM2 was charged to HTM4.

HTM4

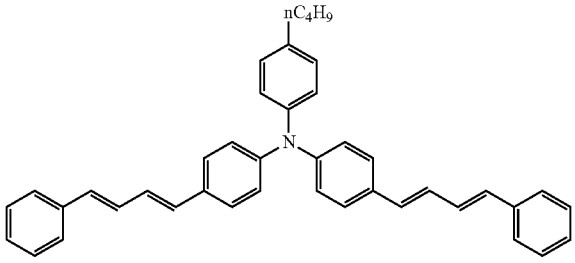

Comparative Example 16

The photosensitive sheet was produced by using the same method used in Example 18 except that AD-8 was not added.

Regarding of the electrophotographic photosensitive sheets of Examples 16 to 18 and Comparative Examples 14 to 16, the measurement of the universal hardness and the elastic deformation rate of the charge transport layer, the evaluation of the electrical properties and the evaluation of the charge retention rate after ozone exposure were performed by using the same method as described above. The results are indicated in the following Table 9.

TABLE 9

| | Charge transport material | Additive (Number of parts) | Universal hardness of charge transport layer ($N/mm^2$) | Elastic deformation rate of charge transport layer (%) | Residual potential (−V) | Charge retention rate after ozone exposure (%) |
|---|---|---|---|---|---|---|
| Example 16 | HTM2 | AD-8 (5) | 170.8 | 44.2 | 99 | 95 |
| Comparative Example 14 | | — | 158.5 | 44.6 | 90 | 93 |
| Example 17 | HTM3 | AD-8 (5) | 157.6 | 44.6 | 54 | 88 |
| Comparative Example 15 | | — | 143.6 | 45.4 | 52 | 82 |
| Example 18 | HTM4 | AD-8 (5) | 149.7 | 43.9 | 60 | 91 |
| Comparative Example 16 | | — | 136.7 | 44 | 56 | 85 |

<Production of Electrophotographic Photoreceptor Drum>

<Preparation of Coating Fluid for Forming Undercoat Layer>

1 kg of a raw-material slurry obtained by mixing 120 parts of methanol with 50 parts of surface-treated titanium oxide obtained by mixing rutile titanium oxide having an average primary-particle diameter of 40 nm ("TTO55N", manufactured by Ishihara Sangyo Co., Ltd.) with methyldimethoxysilane ("TSL8117", manufactured by Toshiba Silicone Co., Ltd.), the amount of which was 3% by mass based on the titanium oxide, by means of a Henschel mixer was subjected to a 1-hour dispersing treatment with Ultra Apex Mill (Type UAM-015) manufactured by Kotobuki Industries Co., Ltd., which had a mill capacity of about 0.15 L, using zirconia beads having a diameter of about 100 μm (YTZ, manufactured by Nikkato Corp.) as a dispersing medium, while circulating the liquid under the conditions of a rotor peripheral speed of 10 m/sec and a liquid flow rate of 10 kg/hr. Thus, a titanium oxide dispersion was produced.

The titanium oxide dispersion and a methanol/1-propanol/toluene mixed solvent were stirred and mixed, with heating, together with pellets of a copolyamide having a composition in which the ε-caprolactam [compound represented by the following Formula (A)]/bis(4-amino-3-methylcyclohexyl) methane [compound represented by the following Formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] molar ratio was 75%/9.5%/3%/9.5%/3%. After the polyamide pellets were dissolved, this mixture was subjected to an ultrasonic dispersion treatment by using an ultrasonic transmitter with an output of 1200 W for one hour, and was further filtered with PTFE membrane filter (Mytex LC manufactured by Advantec Co., Ltd.) having a pore size of 5 μm. Thus, a coating fluid for forming an undercoat layer which had a surface-treated titanium oxide/copolymer polyamide ratio of 3/1 by mass, and a methanol/1-propanol/toluene ratio of 7/1/2 by mass, and had a solid concentration of 18.0% by mass was obtained.

A

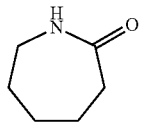

-continued

B

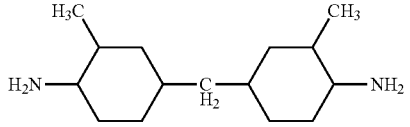

C

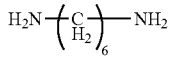

D

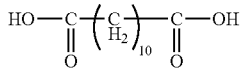

E

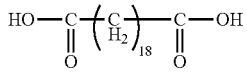

<Preparation of Coating Fluid for Forming Charge Generation Layer>

As the charge generation substance, 20 parts of oxytitanium phthalocyanine showing an X-ray diffraction spectrum by CuKα characteristic radiation in FIG. 2 and 280 parts of 1,2-dimethoxyethane were mixed with each other, and the mixture was subjected to a pulverization/dispersion treatment for one hour by using a sand grinding mill. Subsequently, the resultant fine dispersion was mixed with a binder solution obtained by dissolving 10 parts of polyvinyl butyral (trade name "Denka Butyral" #6000C, manufactured by Denki Kagaku Kogyo K.K.) in a liquid mixture composed of 255 parts of 1,2-dimethoxyethane and 85 parts of 4-methoxy-4-methyl-2-pentanone, and with 230 parts of 1,2-dimethoxyethane to prepare a coating fluid for forming a charge generation layer A.

Figure 3:
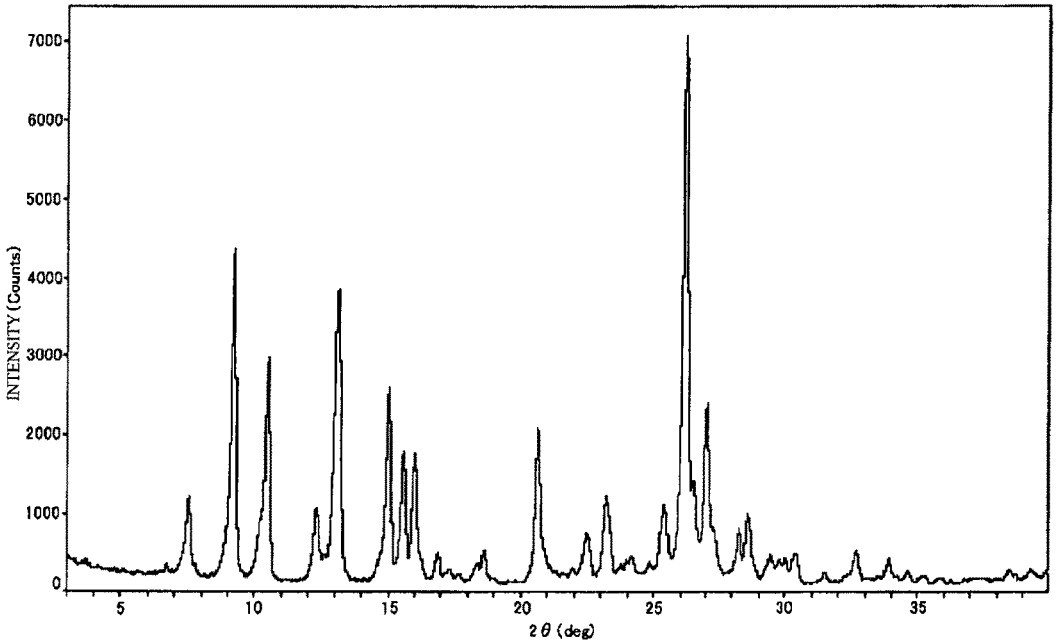
FIG. 3 is a diagram illustrating an X-ray diffraction spectrum by CuKα characteristic radiation of oxytitanium phthalocyanine used in Examples.

As the charge generation substance, 20 parts of oxytitanium phthalocyanine showing an X-ray diffraction spectrum by CuKα characteristic radiation in FIG. 3 and 280 parts of 1,2-dimethoxyethane were mixed with each other, and the mixture was subjected to a pulverization/dispersion treatment for four hours by using a sand grinding mill. Subsequently, the resultant fine dispersion was mixed with a binder solution obtained by dissolving 10 parts of polyvinyl butyral (trade name "Denka Butyral" #6000C, manufactured by Denki Kagaku Kogyo K.K.) in a liquid mixture composed of 255 parts of 1,2-dimethoxyethane and 85 parts of 4-methoxy-4-methyl-2-pentanone, and with 230 parts of 1,2-dimethoxyethane to prepare a coating fluid for forming a charge generation layer B.

The coating fluid for forming a charge generation layer A and the coating fluid for forming a charge generation layer B were mixed with each other at the mass ratio of 55:45 so as to prepare the coating fluid for forming a charge generation layer used in the present examples.

<Preparation of Coating Fluid for Forming a Charge Transport Layer> parts of dimethylpolysiloxane (KF96-10CS, manufactured by Shin-Etsu Chemical Co., Ltd.), represented by the following formula were dissolved into mixed solvent 650 parts of tetrahydrofuran/toluene (8/2 by mass) so as to prepare a coating fluid for forming a charge transport layer C1.

Formula X

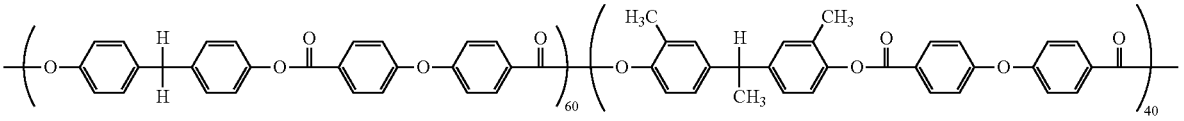

Formula Y

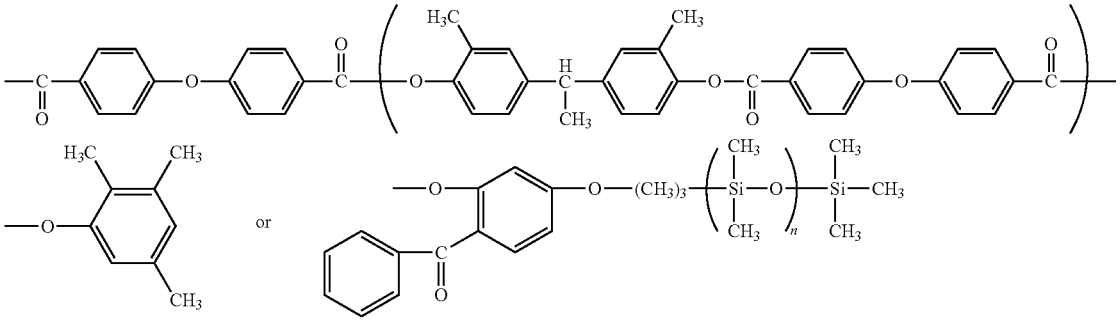

Terminal end

HTM39

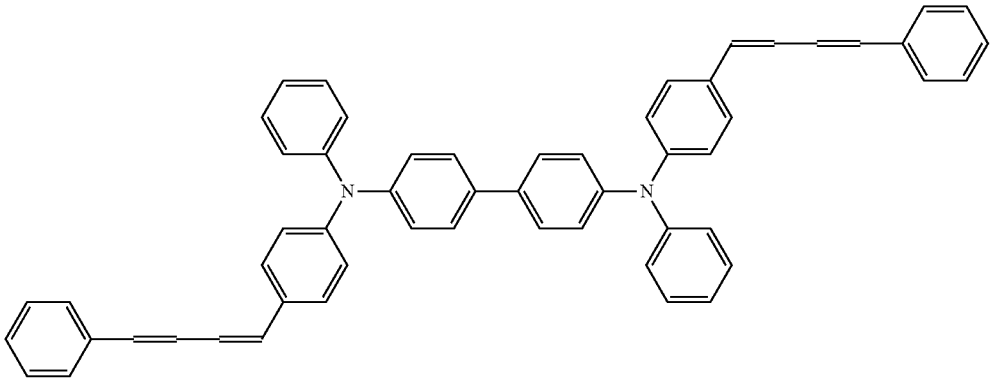

AD-5

AD

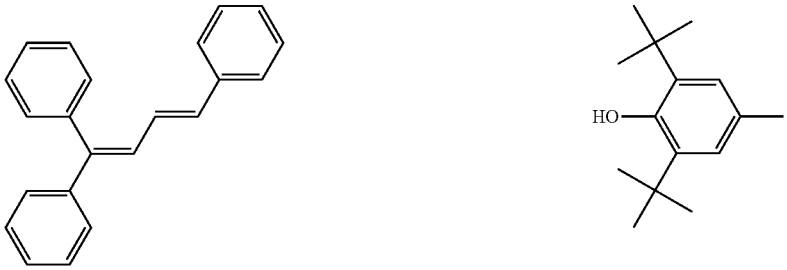

[Coating Fluid C1]

97.2 parts of polyarylate resin (viscosity-average molecular weight, 65,000) represented by the following repeating structure of the Formula X, 2.8 parts of polyarylate resin (viscosity average molecular weight of 49,600, content of polysiloxane structure in polymer, 5.7% by mass) having a repeating structure of the Formula Y and a terminal structure, 70 parts of the charge transport material HTM39 synthesized based on Example 1 disclosed in JP-A-2002-80432, 10 parts of compound AD-5, 2 parts of AD, 0.03

[Coating Fluid C2]

A coating fluid C2 was prepared by using the same method as that used in the preparation of the coating fluid C1 except that the compound represented by the above-described Formula AD-5 is changed to the compound represented by the following Formula AD-13.

AD-13

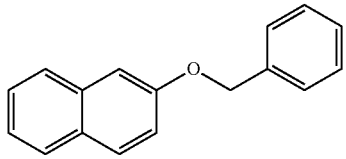

[Coating Fluid C3]

A coating fluid C3 was prepared by using the same method as that used in the preparation of the coating fluid C1 except that a compound represented by the above-described Formula AD-5 was not used.

<Production of Photoreceptor Drum>

Aluminum alloy cylinder in which the surface had been machined and which had an outer diameter of 30 mm, length of 248 mm, and wall thickness of 0.75 mm was subjected to an anodic oxidation treatment, and then a sealing treatment was performed with a sealing agent containing nickel acetate as a main component so to form an anodized film (alumite film) having a thickness of about 6 μm. The obtained cylinder was sequentially coated with the coating fluid for forming an undercoat layer, the coating fluid for forming a charge generation layer, the coating fluid for forming a charge transport layer, which were prepared in Preparing Example of coating fluids by using a dip coating method, and dried so as to from an undercoat layer, a charge generation layer, and a charge transport layer such that each film thickness after drying became 1.5 μm, 0.4 μm, and 36 μm, thereby preparing a photoreceptor drum. Note that, the charge transport layer was dried at 125° C. for 24 minutes.

<Image Test>

The obtained photoreceptor was mounted in the photoreceptor cartridge of a monochromatic printer of ML6510 (contact charging; LD exposure; contact type nonmagnetic two-component development) manufactured by Samsung Co., Ltd., and 400,000-sheet continuous printing was conducted at a coverage rate of 5% under the conditions of an air temperature of 25° C. and a relative humidity of 50%. The amount of film reduction was confirmed by measuring the film thickness of the charge transport layer after printing, and comparing the film thickness before printing with the film thickness after printing so as to evaluate the printing durability.

<Evaluation of Electrophotographic Photoreceptor>

The obtained electrophotographic photoreceptors were each mounted on an apparatus for electrophotographic-property evaluation produced in accordance with the measurement standards of The Society of Electrophotography of Japan (described in The Society of Electrophotography of Japan, ed., *Zoku Denshi Shashin Gijutsu No Kiso To Ōyō*, Corona Publishing Co., Ltd., pp. 404-405, 1996), cycling which included charging, exposure, potential measurement, and erase was performed in the following manner to thereby evaluate the electrical properties. Under the conditions of a temperature of 25° C. and a humidity of 50%, the photoreceptor was charged so as to result in an initial surface potential of −800 V and then exposed, at an irradiation energy of 1.0 μJ/cm$^2$, to monochromatic light of 780 nm obtained from the light of a halogen lamp by means of an interference filter. Thereafter, the surface potential (unit: −V) was measured after 57 msec and taken as residual potential.

Example 19 and Comparative Examples 17 and 18

The photoreceptor drum indicated in Table 10 was produced, and evaluation of the printing durability and the electrophotographic photoreceptor was performed. The results are indicated in Table 10.

TABLE 10

| | Compound | Coating fluid | Film reduction (μm) | Residual potential (−V) | Hardness | Elastic deformation rate |
|---|---|---|---|---|---|---|
| Example 19 | AD-5 | C1 | 8.2 | 94 | 191 | 47.8 |
| Comparative Example 17 | AD-13 | C2 | 9.4 | 115 | 183 | 47.5 |
| Comparative Example 18 | None | C3 | 10.1 | 92 | 172 | 47.4 |

As apparent from Table 10, the electrophotographic photoreceptor of the present invention is a high-functional photoreceptor which has particularly preferable initial potential, and is excellent in the durability with small amount of film reduction at the time of the printing.

Although the invention has been described in detail using specific embodiments, it will be apparent to those skilled in the art that various modifications and variations are possible without departing from the spirit and scope of the invention. Note that, the present application is based on Japanese Patent Application (Japanese Patent Application No. 2014-255338) filed on Dec. 17, 2014, and Japanese Patent Application (Japanese Patent Application No. 2015-191607) filed on Sep. 29, 2015, and its entirety is incorporated by reference.

The invention claimed is:

1. An electrophotographic photoreceptor comprising:

a conductive support; and a photosensitive layer on the conductive support, wherein the photosensitive layer contains a charge transport substance, a binder resin, and a compound which has a molecular weight of equal to or less than 350, and is represented by General Formula (1), and wherein the charge transport substance is a triarylamine derivative or an enamine derivative, and the binder resin is a polycarbonate resin or a polyester resin:

Formula (1)

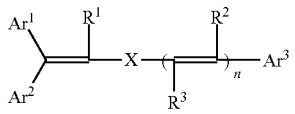

(in Formula (1), $Ar^1$ and $Ar^2$ each independently represent at least one group selected from the group consisting of a hydrogen atom, an alkyl group, a phenyl group which may have an alkyl group, an alkoxy group, or a halogen atom as a substituent, a naphthyl group which may have an alkyl group, an alkoxy group, or a halogen atom as a substituent, and an anthracenyl group which may have an alkyl group, an alkoxy group, or a halogen atom as a substituent, $Ar^3$ represents an aryl group which may have an alkyl group, an alkoxy group, or a halogen atom as a substituent, $R^1$ to $R^3$ each independently represent at least one group selected from the group consisting of a hydrogen atom, an alkyl group, and a phenyl group which may have an alkyl group, an alkoxy group, or a halogen atom as a substituent, X represents a phenylene group which may have an alkyl group, an alkoxy group, or a halogen atom as a substituent, a naphthylene group, or a single bond, n represents an integer in a range of 0 to 3, and at least one of $Ar^1$ and $Ar^2$ is at least one group selected from the group consisting of a phenyl group which may have an alkyl group, an alkoxy group, or a halogen atom as a substituent, a naphthyl group which may have an alkyl group, an alkoxy group, or a halogen atom as a substituent, and an anthracenyl group which may have an alkyl group, an alkoxy group, or a halogen atom as a substituent and $Ar^1$ and $Ar^2$ may be bonded via a carbon atom, an oxygen atom or a sulfur atom, or directly bonded to each other to form a ring).

2. The electrophotographic photoreceptor according to claim 1, wherein the photosensitive layer contains a compound represented by the General Formula (1) in an amount of 0.5 part by mass to 30 parts by mass with respect to 100 parts by mass of the binder resin.

3. The electrophotographic photoreceptor according to claim 1, wherein the molecular weight of the charge transport substance is equal to or greater than 450.

4. The electrophotographic photoreceptor according to claim 1, wherein the elastic deformation rate of the photosensitive layer is equal to or greater than 40%.

5. The electrophotographic photoreceptor according to claim 1, wherein the universal hardness of the photosensitive layer is equal to or greater than 145 $N/mm^2$.

6. An electrophotographic photoreceptor cartridge comprising:

the electrophotographic photoreceptor according to claim 1; and at least one selected from the group consisting of a charging device that charges the electrophotographic photoreceptor, an exposure device that exposes the charged electrophotographic photoreceptor so as to form an electrostatic latent image, and a developing device that develops the electrostatic latent image formed on the electrophotographic photoreceptor.

7. A full color image forming apparatus comprising:

the electrophotographic photoreceptor according to claim 1;

a charging device that charges the electrophotographic photoreceptor;

an exposure device that exposes the charged electrophotographic photoreceptor so as to form an electrostatic latent image; and a developing device that develops the electrostatic latent image formed on the electrophotographic photoreceptor.

* * * * *